US012421849B2

(12) United States Patent
Ash et al.

(10) Patent No.: US 12,421,849 B2
(45) Date of Patent: Sep. 23, 2025

(54) APPARATUS AND METHOD FOR SIGNALLING BETWEEN DOWNHOLE AND UPHOLE LOCATIONS

(71) Applicant: REEVES WIRELINE TECHNOLOGIES LIMITED, Loughborough (GB)

(72) Inventors: Simon Christopher Ash, Newark (GB); Robert Ludeks, Loughborough (GB)

(73) Assignee: REEVES WIRELINE TECHNOLOGIES LIMITED, Loughborough (GB)

( * ) Notice: Subject to any disclaimer, the term of this patent is extended or adjusted under 35 U.S.C. 154(b) by 23 days.

(21) Appl. No.: 18/002,657

(22) PCT Filed: May 25, 2021

(86) PCT No.: PCT/GB2021/051268
§ 371 (c)(1),
(2) Date: Dec. 20, 2022

(87) PCT Pub. No.: WO2022/018395
PCT Pub. Date: Jan. 27, 2022

(65) Prior Publication Data

US 2023/0235665 A1 Jul. 27, 2023

(30) Foreign Application Priority Data

Jul. 20, 2020 (GB) ..... 2011209

(51) Int. Cl.
*E21B 47/24* (2012.01)

(52) U.S. Cl.
CPC ..... *E21B 47/24* (2020.05)

(58) Field of Classification Search
CPC ..... E21B 47/12; E21B 47/14; E21B 47/18; E21B 47/20; E21B 47/22; E21B 47/24
See application file for complete search history.

(56) References Cited

U.S. PATENT DOCUMENTS 5,052,220 A 10/1991 Piers
7,430,153 B2 * 9/2008 Fraser ..... E21B 47/24 367/83

(Continued)

FOREIGN PATENT DOCUMENTS

EP 3346265 A1 11/2018
GB 2372057 A 8/2002

OTHER PUBLICATIONS

GB Search Report issued Mar. 24, 2021 for GB Patent Application No. GB2010248.9, 1 pages.

(Continued)

*Primary Examiner* — Franklin D Balseca
(74) *Attorney, Agent, or Firm* — Smith IP Services, P.C.

(57) ABSTRACT

An apparatus can include a downhole tool having a fluid outlet connectable to a fluid inlet to define a flow path via a hollow interior of the tool, and a valve member capable of opening and constricting or closing the flow path. The apparatus further includes pipe within which a part of the tool is located, the tool being sealed with an interior of the pipe, preventing fluid flow in the pipe via the part of the tool. The pipe includes an openable valve for permitting flow of fluid from the pipe interior via another flow path interconnecting the pipe interior and outside. The valve is normally closed. When the valve member constricts or closes the first flow path, fluid pressure in the pipe increases to cause opening of the valve and venting of pressurized fluid from within the pipe to the outside via the second flow path.

52 Claims, 9 Drawing Sheets

(56) References Cited

U.S. PATENT DOCUMENTS

| | | | | |
|---|---|---|---|---|
| 8,978,773 | B2 | 3/2015 | Tilley | |
| 9,784,095 | B2 * | 10/2017 | Echols, III | E21B 23/02 |
| 9,890,632 | B2 * | 2/2018 | Ma | G01V 5/101 |
| 10,392,931 | B2 * | 8/2019 | Gopalan | E21B 47/24 |
| 10,436,021 | B2 | 10/2019 | Ash et al. | |
| 11,512,578 | B2 * | 11/2022 | Moore | E21B 47/007 |
| 2001/0052427 | A1 | 12/2001 | Eppink et al. | |
| 2002/0060094 | A1 | 5/2002 | Meister et al. | |
| 2002/0117300 | A1 * | 8/2002 | Spencer | E21B 23/08 166/383 |
| 2006/0202700 | A1 | 9/2006 | Barolak et al. | |
| 2007/0029197 | A1 | 2/2007 | DiFoggio et al. | |
| 2008/0202767 | A1 | 8/2008 | Sheiretov et al. | |
| 2009/0101330 | A1 | 4/2009 | Johnson | |
| 2009/0243604 | A1 | 10/2009 | Dutta et al. | |
| 2011/0056681 | A1 | 3/2011 | Khan | |
| 2013/0068475 | A1 | 3/2013 | Hofman et al. | |
| 2017/0298707 | A1 | 10/2017 | Sargent et al. | |

OTHER PUBLICATIONS

PCT Search Report issued Sep. 15, 2021 for PCT Patent Application No. PCT/GB2021/051268, 5 pages.

PCT Written Opinion issued Sep. 15, 2021 for PCT Patent Application No. PCT/GB2021/051268, 8 pages.

Search report for UK application No. GB2011209.0, dated Dec. 2, 2020.

* cited by examiner

APPARATUS AND METHOD FOR SIGNALLING BETWEEN DOWNHOLE AND UPHOLE LOCATIONS

The disclosure hereof relates to apparatuses and methods for signalling between downhole and uphole locations in a borehole. In particular the disclosure relates to apparatuses and methods for signalling between a logging tool in a downhole location and an uphole location such as a surface location at which processing equipment for signals generated by the logging tool is positioned. The disclosure also is of relevance to signalling between other types of downhole tool and uphole locations.

Embodiments disclosed herein relate chiefly to the field of geological logging and other aspects of borehole technology. Within this field the topic of reliable communications between downhole and uphole locations (the terms "downhole" and "uphole" being familiar to the person of skill in the art, and not requiring explanation herein) is of significant importance. As explained in more detail below although useful downlink communications methods (i.e. communications from a surface location to tools located downhole) have been proposed in the art and are in use, the topic of uplink communications, from autonomous downhole tools in an uphole direction, hitherto has not been addressed as successfully.

In broad terms logging typically involves inserting a logging tool, that in most cases is an elongate, rigid cylinder, into a borehole where the logging tool generates log signals that are indicative of the geological and other characteristics of the environment surrounding the borehole.

Parameters of the signals are formed into logs which are ordered collections of signals, parts of signals and/or information representing downhole conditions and constituted by or derived from the log signals. Depending on their exact nature such logs may be stored, transmitted, further processed, displayed or printed and they may be represented as mathematical models or functions, collections of data values or various forms of graphical image including coloured plots and graph traces. The essence of a log however is a plurality of physical signals, and references herein to "log data" generally are references to such signals (or parts or derivatives of signals).

Logging is extensively used in the oil and gas industries, for example to identify regions of rock that bear hydrocarbons the recovery of which is desired. It further is used in such industries to identify regions of geology that may be problematic from the standpoint of rock stability, ease of drilling, water (or other chemical) injection and various aspects associated with the production of hydrocarbons.

Logging also is of use in the identification of subterranean sources of other chemicals, including water such as groundwater, or to help locate regions that are likely to be good sources of geothermal energy; and additionally in other branches of mineral recovery such as shaft and open-cast mining.

Logging moreover is of use in the mining, construction and tunnelling industries when for example it is desired to establish the stability of rock or the relative ease with which it can be drilled, cut, detonated or dug.

Yet a further application of logging is in the "carbon capture" industry in which carbon dioxide that otherwise would escape into the atmosphere may be stored in subterranean locations where it does not influence the climate systems of the Earth. Logging may be used to assess the suitability of underground locations for this purpose.

Logging is economically an important activity. The process of logging is of high commercial value; and it often is key to promoting higher value activities associated with e.g. production from an oil or gas field.

The invention is of use potentially in all such applications of logging. As noted the Invention also is of use when a need arises for communication by a downhole tool other than a logging tool.

Many boreholes are formed e.g. by drilling downwardly, either vertically downwardly or inclinedly downwardly, into rock such as the ground or a sea bed. It is also well known to create boreholes that extend predominantly horizontally, e.g. sideways into a subsurface geological structure.

Logging techniques have been developed for conveying downhole tools, including logging tools, in a great variety of borehole types and designs, Embodiments disclosed herein are useful inter alia in the logging of a wide range of boreholes.

Usually the generated log signals are electrical signals, although this is not always the case. Electrical log signals can be transmitted to a surface location for example using wireline (i.e. elongate, armoured cabling that connects the logging tool to a surface location and permits the transmission of log data signals, commands and electrical power between the logging tool and the surface location or vice versa). Wireline logging has the advantage that the log data signals are sent via broadband communications methods to a surface location, where they can be processed, analysed, stored, displayed and/or transmitted, in real-time or near real-time.

In several forms of logging however it is not practical or possible for the wireline to remain connected to the logging tool while logging takes place. As an example in this regard one may consider a number of logging techniques in which a logging tool is conveyed to a downhole location inside drill pipe (the nature of which is well known to the person of skill in the art) and then moved to protrude from the end of the drill pipe for purposes of logging the geology in a region downhole of the drill pipe. This type of deployment is sometimes referred to as "tool drop-off" deployment.

During running in or tripping of the logging tool (the terms "running in" and "tripping" also being familiar in the downhole tool art) in this manner the wireline extends from the surface termination of the borehole along a length of the exterior of the drill pipe, and passes inside it via a drill pipe section known as a "side entry sub", the term "sub" being familiar to the person of skill in the art. From the position of the side entry sub to the location of the logging tool the wireline extends inside the hollow interior of the drill pipe and is connected to the uphole end of the logging tool also inside the drill pipe. The wireline is paid out from a surface-located drum in a known manner as the drill pipe lengthens to convey the logging tool in a downhole direction according to known techniques.

This arrangement permits uplink and downlink communications to take place via the wireline during running in of the logging tool and up to a time shortly before deployment of the logging tool to a location protruding from the drill pipe occurs.

Following deployment however the drill pipe must rotate for example in order to cause rotation of a drill head through which the logging tool protrudes into the open hole beyond the drill pipe and in some instances for purposes of downlink communication. The presence of the wireline entering the drill pipe via the side entry sub would impede such rotation. Damage to or destruction of the wireline would occur if the latter were to remain in place connected to the logging tool when rotation commences. Once the drill pipe has been run in to the desired depth therefore the wireline is disconnected from the logging tool and withdrawn via the side entry sub and completely out of the borehole back on to the surface-located deployment drum.

A command then may be sent to the logging tool and associated equipment (i.e. downlink communication) causing the logging tool to commence a final deployment step such that it protrudes as explained and then commences logging operations. This command may be conveyed e.g. in the form of characteristic rotations of the drill pipe that cause the logging tool also to rotate; through the transmission of coded pressure pulses in fluid in the drill pipe; or through pumping of a messenger device in the fluid along the drill pipe to effect activation of a process in the downhole tool. The downhole tool or apparatus associated with it includes apparatus as appropriate for detecting such rotation, the pressure pulses or arrival of the messenger sub.

Thus for example when drill pipe rotation is employed a rotation sensor such as an accelerometer supported on the logging tool may then generate a signal, such as an electrical signal, that initiates the desired action such as the desired movement of the logging tool. Pressure pulse and messenger communications techniques may through activation of appropriate detection/sensing arrangements result in mechanical actuation or the generation of e.g. electrical signals, depending on the exact arrangement employed. Combinations of different downlink signalling regimes may be used in one and the same instance. The disclosure hereof extends to the use of the invention in conjunction with such combinations of downlink communications techniques.

Downlink communications of the aforesaid kinds are known and are successful in part because their generation relies on the ability to locate appropriate equipment, such as powerful pumps and rotary tables, at surface locations. The power of such devices hitherto however has been hard to replicate in equipment located downhole, making the generation of similar uplink signals difficult or impossible to achieve.

A feature known as a no-go formed in the lowermost section of drill pipe in a manner partially occluding its central bore is engaged by an annulus protruding from the logging tool in order to prevent the logging tool from separating completely from the drill pipe following protrusion of the logging tool in accordance with the foregoing techniques. As a result part of the logging tool remains within the drill pipe and part, that is capable of performing logging actions, protrudes from it. Various mechanisms are known for locking the drill pipe in this position so that subsequent movements of the drill pipe and other perturbations do not dislodge it.

The logging tool in such a scenario includes an on-board power source such as a set of batteries; and a memory for recording the log data signals. This type of logging tool completes a logging operation as the drill pipe is gradually removed from the borehole, causing movement of the logging tool in an uphole direction. At the end of logging, i.e. once all the drill pipe has been removed from the borehole, the logging tool is recovered to a surface location at which the log data are downloaded, typically as electrical signals, for processing and analysis.

Other methods of logging tool deployment that can give rise to similar uplink communications deficiencies as affect drop-off logging tools include so-called "pump down" deployment, in which a completely autonomous logging tool including an on-board power source and a memory is pumped in fluid filling installed drill pipe from the surface to a downhole location at which logging is to take place. Some types of logging tool used in pump down deployment are never connected via wireline, giving rise to potential uplink communications requirements that are at least as acute as those explained above. The disclosure hereof is applicable when the deployment technique is of the pump down type.

Logging in the majority of cases involves causing the logging tool exposed to the material of the borehole to emit energy into the surrounding rock. A key facet of deployment techniques therefore is to ensure that the relevant sections of the logging tool are correctly positioned adjacent the borehole wall to enable logging to occur.

The energy emitted once this is the case passes from the point(s) of emission to one or more receivers of energy that are spaced from the emission point(s). In many, but not all, cases the receivers are spaced along the body of the logging tool from one or more energy emitters.

An aim in many types of logging is to cause the emitted energy to pass through the surrounding rock before it encounters the receivers. The passage of the energy through the rock alters its character. The receivers are sensitive to the received energy and are arranged to generate signals that are characteristic of it.

Such signals imply information about conditions such as the physical and chemical properties encountered by the energy on the path(s) between the emitter(s) and the receivers.

The presence of an on-board power source and memory forming part of the logging tool means that such operations can occur with high reliability if the logging tool deploys correctly. Following disconnection of the wireline however in drop-off tools, and generally in pump down tools, the logging tool is unable to signal electronically or electrically to a surface or other uphole location that it has deployed satisfactorily and is able to produce reliable log data. It is however important for such signalling to occur promptly and reliably in order to avoid the cost of time that becomes wasted when incorrect deployment prevents logging from taking place.

In the prior art such uplink communication has been attempted using coded pressure pulses generated by the logging tool in the mud or other fluid in the borehole. Pressure pulse detection equipment at a surface location may be employed in an attempt to detect and interpret the pressure pulse signals indicating deployment of the logging tool to an operational position protruding from the drill pipe. Following detection of a signal indicating readiness of the tool to commence logging activity a downlink command may be sent as described in order to initiate logging activity, or cause commencement of another task that the downhole tool is capable of carrying out.

The known methods of pressure pulse generation for uplink communication purposes are not as reliable as the logging industry demands. The main reason for this is that the pressure pulse signals are ambiguous and hard to detect. This in turn can be because the formation through which the borehole is drilled may be of a type categorised as a "losing" or "gaining" well. As these names imply the material of the formation may cause the pressure of fluid in the borehole to increase or decrease in a time-dependent yet often unpredictable manner. As a result the medium in which it is required to detect the uplink fluid pressure signals (i.e. the borehole fluid at the surface location) may be contaminated by pressure signal noise and spurious signal artefacts that may for instance resemble or mask the desired signals in a confusing manner.

Even if this is not the case the amplitude of the uplink communication signal typically is small compared with the effect of pressure loss or gain resulting from the well characteristics. This makes the uplink communication signal hard to identify.

Furthermore the pressure signal detected at the surface location may not as a result of the well characteristics resemble that generated downhole. This further complicates the signal detection and interpretation task, since it may not be possible to correlate the signals received at the surface location to those expected or to particular events downhole.

In some examples of losing and gaining wells it becomes possible to detect the uplink signals generated using prior art techniques only after a considerable delay that is needed to allow the well conditions to stabilise sufficiently that signal detection is possible. For a number of reasons such delay is strongly undesirable.

U.S. Pat. No. 10,436,021 B, the content of which is incorporated herein by reference, describes an apparatus and method employing rotational signalling in downlink communications.

US 2009/0101330 A1 discloses an injection fluid distribution configuration for use in well completion and including a tubular having a plurality of openings and a plurality of beaded matrixes disposed within the openings.

US 2008/0202767 A1 discloses a well logging instrument deployment device including a housing that is configured to be coupled to a pipe string. A carrier sub is moveable along the housing and is coupled to a logging instrument. A latch is capable of retaining the logging instrument and carrier sub such that the well logging instrument extends outwardly from the housing.

US 2002/0060094 A1 discloses a minimum volume apparatus including a tool for obtaining at least one parameter of a subterranean formation. The tool comprises a carrier member, a selectively extendable member mounted on the carrier for isolating a portion of annulus, a port that is exposable to formation fluid in the isolated annulus, a piston integrally disposed within the extendable member for urging fluid into the port, and a sensor operatively associated with the port for detecting at least one parameter of interest of the fluid.

US 2011/0056681 A1 discloses a method and apparatus for logging an underbalanced open hole well without killing the well or causing formation damage to maintain well control during the process. The installation of the well logging equipment is accomplished while holding the underbalanced open hole at its optimal pressure, then conveying the logging string into the open hole portion to total depth and logging while removing the logging string from the total depth to be logged with a cable side entry sub.

US 2001/0052427 A1 discloses a steering assembly for downhole use including upper and lower tubular housings that are connected by a universal joint. The disclosed apparatus is capable of generating commands that operate the steering assembly to change the direction of downhole drilling.

US 2007/0029197 A1 discloses a downhole actuator comprising an electroactive polymer, an advancement device and an electrical source for stimulating the electroactive polymer.

U.S. Pat. No. 5,052,220 B discloses a logging tool for measuring the fluid flow rate in a well comprising a measuring pipe provided with a flow meter, a packer device intended to derive the whole fluid flow into the measuring pipe and an obstacle placed in the fluid flow path at or downstream of the exit of the packer. The apparatus increases the pressure of fluid located upstream of the packer.

There is a need in the art for improved apparatuses and methods for effecting uplink communication from downhole tools to uphole locations.

According to embodiments disclosed herein apparatus for signalling between downhole and uphole locations in a borehole comprises a downhole tool having a hollow interior; a fluid inlet; a fluid outlet that is connectable to the fluid inlet to define a first fluid flow path via the hollow interior; and a moveable valve member that is capable of selectively opening and constricting or closing the first fluid flow path, the apparatus further including pipe (such as but not limited to drill pipe) within which at least part of the downhole tool is moveably located, the downhole tool being peripherally sealed to the interior of the pipe in a manner preventing fluid flow in the pipe via part of the exterior of the downhole tool; the downhole tool being constrained to lie at least partially within the pipe; and the pipe including an openable valve permitting flow of fluid from the Interior of the pipe via one or more second fluid flow path interconnecting the interior of the pipe and the outside, wherein the openable valve is normally closed and wherein when the moveable valve member constricts or closes the first fluid flow path fluid pressure in the pipe increases to cause opening of the openable valve and venting of pressurised fluid from within the pipe to the outside via at least one said second fluid flow path.

An advantage of such apparatus is that the apparatus is capable of generating one or more pressure signal, in fluid within the pipe, that is of a characteristic form and/or of large amplitude, with any excess pressure venting via the second fluid flow path whereby the pressure signal in the pipe is controlled, characteristic and of a predictable form. As a consequence such a signal is easy to detect and characterise using surface-located equipment even if otherwise confusing factors, such as but not limited to the characterisation of a well as "losing" or "gaining", influence the uplink signal(s). The generated signal(s) transmit to a surface location virtually instantaneously as a result of the fundamentally incompressible nature of typical borehole fluid.

The apparatus moreover may be manufactured using robust parts that readily can cope with the harsh environments that arise in downhole locations. Engineering the apparatus in this way means it is possible to generate the desired large amplitude signals.

Drill pipe that preferably is used as part of the apparatus moreover may readily and robustly be modified to accommodate the parts defining the openable valve. The integrity of the pipe need not be compromised as a result of such modification. This is an important advantage because drill pipe and similar pipe types such as wash pipe are used almost universally in drilling and related operations. There is an expectation among drilling professionals that such pipe reliably will perform to minimum standards.

As is known to the person of skill in the art wash pipe is similar to drill pipe, may be connected in a drill pipe string and is of larger internal diameter than drill pipe. For the purposes of this disclosure wash pipe is functionally similar to or the same as drill pipe. References herein to drill pipe, or more generally pipe, therefore when the context supports this may be taken as references to such other, similar types of pipe even though they may not specifically be mentioned. Furthermore references to pipe, drill pipe or wash pipe embrace and are references to other, equivalent hollow elements that are useable for protected downhole tool conveyance as described, even if such elements are not formally identified as drill pipe or wash pipe.

Preferably the downhole tool is a logging tool. It is anticipated that the apparatus of embodiments will be of greatest utility when this is the case, since logging tools most commonly are those deployed using shuttle (pump down), wireline drop-off and similar techniques as described above. However the disclosure is not limited to apparatus including a logging tool. On the contrary, the downhole tool may be of any of a range of other types if desired and may be a single-purpose, multi-purpose or hybrid tool that may or may not provide logging functionality.

When the downhole tool is a logging tool the disclosure is not limited to any particular kind of such a tool. On the contrary the disclosure relates to a wide range of logging tool types, it being essential chiefly that the logging tool is such as to give rise to a need to signal a deployment or similar event from a downhole location to an uphole one such as but not limited to a surface location.

Various such logging tools are known to the person of skill in the art and do not require to be described herein.

In preferred embodiments the fluid inlet and the fluid outlet are respective apertures that are spaced from one another along the length of the downhole tool and that each perforate a wall of the downhole tool whereby the hollow interior interconnects the fluid inlet and the fluid outlet. Such an arrangement is particularly beneficial when the downhole tool is a logging tool because many designs of such tools include at least a section or sub that includes an elongate hollow interior. Modifying this to provide the apertures is relatively straightforward to achieve.

In practical embodiments the fluid inlet in use preferably lies uphole of the fluid outlet. This arrangement takes advantage of the normal direction of circulation of fluid in a borehole, i.e. involving pumping of fluid in a downhole direction inside the drill pipe, passage of the fluid out of the lowermost end of the drill pipe (or e.g. a bottom hole assembly fixed thereto) to the exterior thereof, and return flow in an uphole direction via the annular gap between the drill pipe and the rock in which the borehole is drilled. However it is possible within the scope of the disclosure, although unlikely based on current rig designs, to arrange for fluid circulation in a reverse direction, in which case the designations of the inlet and the outlet apertures would be reversed.

Conveniently the moveable valve member is or includes a piston that is moveable in the hollow interior between a valve open position in which it is spaced from the fluid inlet; and a valve closed position in which the piston lies adjacent to and constricts or closes the fluid inlet. The use of such a piston, that may conveniently be mounted on e.g. a piston rod that is selectively energised to provide for its movement, provides a reliable way of selectively closing and opening the fluid flow path defined inside the downhole tool.

Typically the apparatus includes one or more actuator for effecting movement of the piston between the valve open position and the valve closed position when the downhole tool protrudes partially from the pipe. Such an actuator in embodiments may form part of the downhole tool and may be or may include e.g. an electric or hydraulic motor that responds to commands initiated at a surface location or to the detected tool status. When commands are sent from a surface location these may be or include e.g. pressure pulses, drill pipe rotations or combinations of command signal types.

In embodiments the downhole tool includes extending about its exterior at least one sealing member that effects a fluid-proof seal between the downhole tool and the interior of the drill pipe or wash pipe. Such a sealing member may permit movement of the downhole tool along the pipe, while maintaining a seal that prevents the flow of fluid past the downhole tool via its exterior. Designs of such sealing members are known to the person of skill in the art and may include e.g. one or more reinforced elastomeric annulus that is bonded to the exterior of the downhole tool and of a diameter that defines a seal with the inner wall of the pipe.

Preferably the interior of the pipe may include one or more inwardly directed projection and the pipe may include one or more outwardly directed projection that is engageable with a said inwardly directed projection, mutual engagement of the inwardly and outwardly directed projections constraining the logging tool to lie partially within the pipe with a length of the downhole tool protruding from the said pipe in a downhole direction.

In one particularly preferred embodiment the sealing member and the one or more outwardly directed projection form part of and/or are supported by a seal and projection section of the downhole tool.

In embodiments the one or more inwardly directed projections may be or may include an annular projection secured to and protruding inwardly from an interior surface of the pipe; and the one or more outwardly directed projections may be or may include an annular projection secured to and protruding outwardly from an outer surface of the downhole tool and being located uphole of the inwardly directed annular projection, the outwardly directed annular projection being too large to pass through the inwardly directed annular projection on movement of the downhole tool in a downhole direction that causes the outwardly directed annular projection to approach the inwardly directed annular projection.

In other words the apparatus may include a no-go that in preferred embodiments is an annular design that is familiar to those of skill in the art. However other forms of no-go, including but not limited to part-annular designs and other protruding members, are possible within the scope of the disclosure.

Optionally the apparatus may include one or more shock absorbing element that is retained relative to the downhole tool in a region between the one or more outwardly directed projection and the one or more inwardly directed projection thereby permitting indirect engagement between the one or more inwardly directed and outwardly directed projections in order to buffer impulses arising on mutual approach of the one or more inwardly and outwardly directed projections during movement of the downhole tool in a downhole direction. Preferably the one or more shock absorbing element encircles the downhole tool in a region between the one or more inwardly directed projection and the one or more outwardly directed projection; and more preferably the one or more shock absorbing element is or includes a crushable tube that encircles the downhole tool.

Examples of suitable forms of shock absorbing element are described in publication GB 2512895 A, the disclosure of which is incorporated herein by reference. Other shock absorber element types also are useable. In embodiments described herein a swage-type shock absorber is employed. To this end optionally the one or more shock absorbing element includes a swage element that lies externally of the downhole tool; and the apparatus includes a swage member that is fixable relative to the downhole tool and is moveable in engagement with the swage element on movement of the downhole tool in a downhole direction beyond a predetermined position in a manner dissipating kinetic energy of the downhole tool.

An advantage of a swage tube shock absorber is that its shock absorbing capability may be used up over a number of impulse events with the result that it can absorb multiple impacts should these arise.

In embodiments the swage element is or includes a tube that encircles the downhole tool.

Preferably the or each second fluid flow path is or includes one or more aperture perforating a wall of the pipe. Other forms of the second fluid flow path however are possible. As noted arrangements are possible in which the second fluid flow path is defined as a single aperture perforating the pipe, Conveniently the openable valve includes a moveable tubular valve member that lies within the pipe and a biasing arrangement that causes the tubular valve member normally to close the second fluid flow path, advantageously by lying adjacent the one or more aperture.

The dimensions of the tubular valve member preferably are chosen such that it is a sliding fit inside the pipe, which therefore guides movement of the tubular valve member along the interior of the pipe between valve open and valve closed positions. The tubular valve member moreover may be dimensioned such that it does not impede the flow of fluid or the passage of objects inside the pipe.

In embodiments including the tubular valve member preferably the biasing arrangement includes an inwardly directed valve bias projection that protrudes inwardly from a wall of the pipe at a location downhole of the tubular valve member; and a hollow spring extending between the inwardly directed valve bias projection and a location uphole thereof whereby the hollow spring acts on the tubular valve member and biases it to a position closing the or each second fluid flow path. The valve bias projection conveniently but non-limitingly may be embodied as e.g. a shoulder or similar feature.

As an optional feature the apparatus may include a spring core tube lying inside and supporting the hollow spring. Such a tube constrains the spring and ensures that it does not distort or become dislodged when compressing and extending, or damaged by debris in fluid flowing past it. The tubular valve member and the spring core tube preferably define respective hollow interiors the sizes of which are such as to permit passage of the downhole tool within and along the tubular valve member and the spring core tube.

Conveniently the apparatus includes a space between the tubular valve member and the pipe, the space being bounded at either end respectively by an inwardly directed protuberance protruding towards the interior of the pipe and an outwardly directed protuberance protruding from the tubular valve member whereby to define an essentially closed chamber, the tubular valve member being perforated in the vicinity of the space whereby fluid pressure acting within the tubular valve member acts on the inwardly and outwardly directed protuberances to urge them apart from one another and cause movement of the tubular valve member to open the openable valve.

Such movement of the tubular valve member opposes the biasing effect of the biasing arrangement. Preferably the space is annular and the inwardly directed and outwardly directed protuberances are shaped accordingly. Further preferably, when the space is annular the tubular valve member includes plural perforations defining an annular pattern that corresponds to the annular shape of the space.

In embodiments the apparatus may include or support one or more sensor elements that are secured relative to the pipe and the downhole tool may include one or more sensors, the one or more sensors detecting the one or more sensor elements on movement of the downhole tool to a deployed location and generating one or more signals indicative of such movement of the downhole tool.

The one or more sensor elements may conveniently be one or more magnets; and the one or more sensors may be one or more Hall effect devices that detect magnetic field energy radiated by the one or more sensor elements. However other types of sensor element and sensor are possible within the scope of the disclosure.

It is not essential that the sensors are supported on the downhole tool and the sensor elements on the tubular parts of the apparatus as indicated. In other embodiments this arrangement may be reversed so that the sensors are supported relative to the pipe and the sensor elements are supported on the downhole tool. However the described arrangement is potentially beneficial since the sensors may as a result be directly connected to processing equipment forming part of or connected to the downhole tool.

The apparatus disclosed herein may include at an uphole location (that typically but not necessarily is a surface location) one or more detectors of a pressure pulse that arises at the time of venting of pressurised fluid from within the pipe to the outside via the second fluid flow path, the one or more detectors generating one or more signals indicative of such a pressure pulse. Numerous suitable designs of such detectors are known in the art.

The disclosed apparatus may include one or more processor for processing one or more signals generated by the one or more sensors and generating one or more control commands based on the said signals. Typically such a processor would form part of or be supported by the downhole tool, although in some embodiments this need not be the case. Instead one or more such processor may be supported e.g. on the pipe, or on equipment that is separate from the apparatus of the disclosure.

Distributed processing arrangements are possible, in which for example plural processors are distributed at convenient locations in the apparatus.

Regardless of the precise processor arrangement, preferably the downhole tool is configured to respond to the one or more control commands by one or more of initiating an action, continuing an action, ceasing an action and/or modifying an action. As non-limiting examples such actions may be selected from the list including deploying one or more deployable components; commencing logging activity; terminating logging activity; adjusting a parameter of logging activity; processing one or more signals resulting from logging activity; requesting diagnostic information and/or responding to one or more requests for diagnostic information.

The apparatus also typically includes one or more processor for processing one or more signals generated by the one or more detectors and generating one or more indications based on the said signals. Such a processor in practice will be separate from the one or more processor for processing one or more signals generated by the one or more sensors, because of the need for one of the processor types to be located downhole and the other at an uphole position.

Conveniently the one or more indications may include one or more selected from the list including an indication of deployment of the downhole tool; an indication of failure of the downhole tool to deploy; and/or diagnostic information received from the downhole tool. The indication options may include e.g. an indication of the start or end of logging activity, and indications relating to conditions of the downhole tool such as but not limited to the state of charge of any on-board batteries or the capacity of a memory.

Preferably the apparatus may include one or more display devices (such as but not limited to one or more display screens) for displaying the one or more indications. Additionally or alternatively the apparatus may include other means of alerting of the one or more indications. Such means may include e.g. an audible or haptic alarm or one or more optical devices such as a warning lamp, multi-segment display or similar device.

The disclosure hereof additionally extends to a method of signalling between downhole and uphole locations in a borehole, the method comprising conveying to a downhole location inside a pipe a downhole tool having a hollow interior; a fluid inlet; a fluid outlet that is connectable to the fluid inlet to define a first fluid flow path via the hollow interior; and a moveable valve member that is capable of selectively opening and constricting or closing the first fluid flow path, the pipe including an openable valve permitting flow of fluid from the interior of the pipe via a second fluid flow path Interconnecting the interior of the pipe and the outside, wherein the openable valve is normally closed and the downhole tool is peripherally sealed to the interior of the pipe in a manner preventing fluid flow in the pipe via part of the exterior of the downhole tool; and causing the moveable member to constrict or close the first fluid flow path and effect an increase in the pressure of fluid in the pipe and thereby cause opening of the openable valve and venting of pressurised fluid from within the pipe to the outside via the or each second fluid flow path.

Such a method advantageously may be carried into effect using apparatus as disclosed herein. In particular the downhole tool may be or may include a logging tool.

Preferably the method includes the step of causing the downhole tool to move in the pipe to a position partially protruding from the pipe; and subsequently causing the moveable valve member to constrict or close the first fluid flow path and effect an increase in the pressure of fluid in the pipe. As a result the method of the invention may involve the generation of a pressure increase that is highly suitable for uphole signalling communicating the deployment status (or, if desired, another variable as mentioned) of a downhole tool.

Conveniently the interior of the pipe includes one or more inwardly directed projection and the pipe includes one or more outwardly directed projection that is engageable with a said inwardly directed projection, the method including causing mutual engagement of the inwardly and outwardly directed projections that constrains the logging tool to lie partially within the pipe with a length of the downhole tool protruding from the pipe in a downhole direction.

Such mutual engagement may include direct engagement, in which the inwardly and outwardly directed projections contact each other; and indirect engagement, in which an intermediate component interconnects the inwardly and outwardly directed projections when the mutual engagement occurs.

In the latter case the method may include causing one or more shock absorbing element that is retained relative to the downhole tool in a region between the one or more outwardly directed projection and the one or more inwardly directed projection to absorb impact energy on mutual engagement of the inwardly and outwardly directed projections. In such a scenario the shock absorbing element is or is part of an intermediate component as referred to above.

The openable valve may include a tubular valve member that lies within the pipe and a biasing arrangement that causes the tubular valve member normally to close the second fluid flow path. In such a case the method may include causing or permitting the biasing arrangement to bias the openable valve to a normally closed position.

In embodiments the apparatus preferably includes a space between the tubular valve member and the pipe, the space being bounded at either end respectively by an inwardly directed protuberance protruding towards the interior of the pipe and an outwardly directed protuberance protruding from the tubular valve member whereby to define an essentially closed chamber, the tubular valve member being perforated in the vicinity of the space and the method including causing fluid pressure acting within the tubular valve member to act on the inwardly and outwardly directed protuberances to urge them apart from one another and cause movement of the tubular valve member to open the openable valve.

Preferably the said movement of the tubular valve member opposes the biasing effect of the biasing arrangement when this is present.

Preferably the apparatus includes or supports one or more sensor elements and the method may include operating one or more sensors that are secured relative to the downhole tool to detect the one or more sensor elements on movement of the downhole tool to a deployed location and generate one or more signals indicative of such movement of the downhole tool.

Also preferably the method may include activating at an uphole location, such as but not limited to a surface location, one or more detectors of a pressure pulse that arises at the time of venting of pressurised fluid from within the pipe to the outside via the or each second fluid flow path, and causing the one or more detectors to generate one or more signals indicative of such a pressure pulse. The thus-generated signals may be of an information kind intended for interpretation by humans; or they may be capable of being interpreted by devices such as processors, computers, neural networks or artificial intelligence devices; or they may be or may give rise to commands that effect further steps in apparatus as disclosed herein or in further apparatus operatively connected to it.

In this regard the method may include operating one or more processor for processing one or more signals generated by the one or more sensors and generating one or more control commands based on the said signals. The method further may include causing the downhole tool to respond to the one or more control commands by one or more of initiating an action, continuing an action, ceasing an action and/or modifying an action.

Such action advantageously may be selected from the list including deploying one or more deployable components; commencing logging activity; terminating logging activity; adjusting a parameter of logging activity; processing one or more signals resulting from logging activity; requesting diagnostic information and/or responding to one or more requests for diagnostic information.

Additionally or alternatively the method may include causing one or more processor to process one or more signals generated by the one or more detectors and generate one or more indications based on the said signals. The one or more indications may include but are not limited to one or more selected from the list including an indication of deployment of the downhole tool; an indication of failure of the downhole tool to deploy; and/or diagnostic information received from the downhole tool.

The disclosed method further may include one or more of (a) causing one or more display devices to display the one or more indications; (b) causing one or more printing devices to print indicia representing the one or more indications; (c) causing one or more memory devices to record data characteristic of the one or more indications; or (d) generating one or more visible, audible or other sensory alert.

There now follows a description of preferred embodiments, by way of non-limiting example, with reference being made to the accompanying drawings in which.

Figure 1:
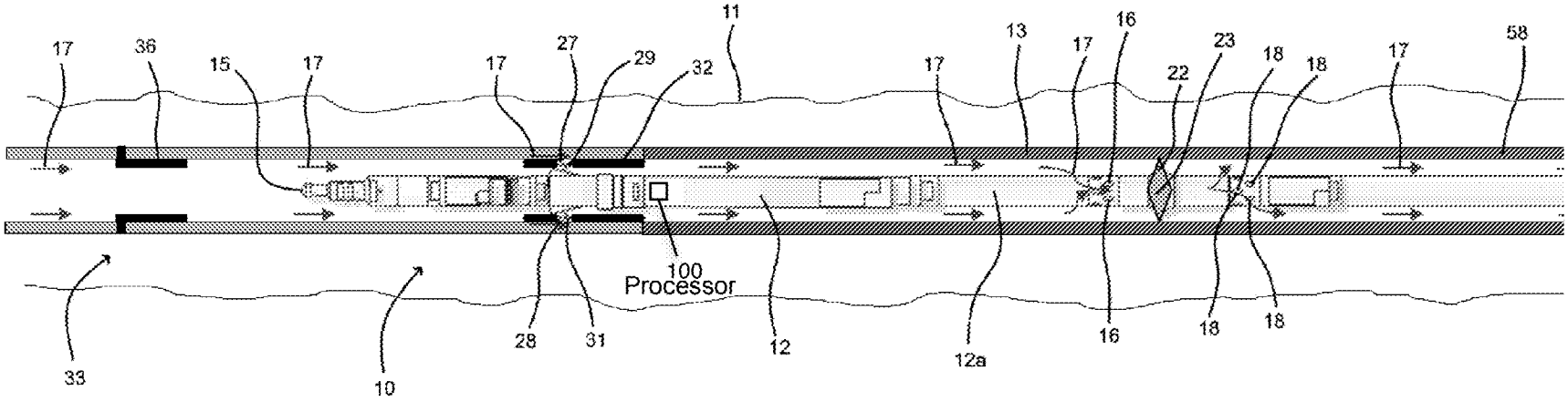
FIG. 1 is a schematic, partly-sectioned view of apparatus according to the disclosure hereof and illustrating in part the method disclosed herein.
Figure 2:
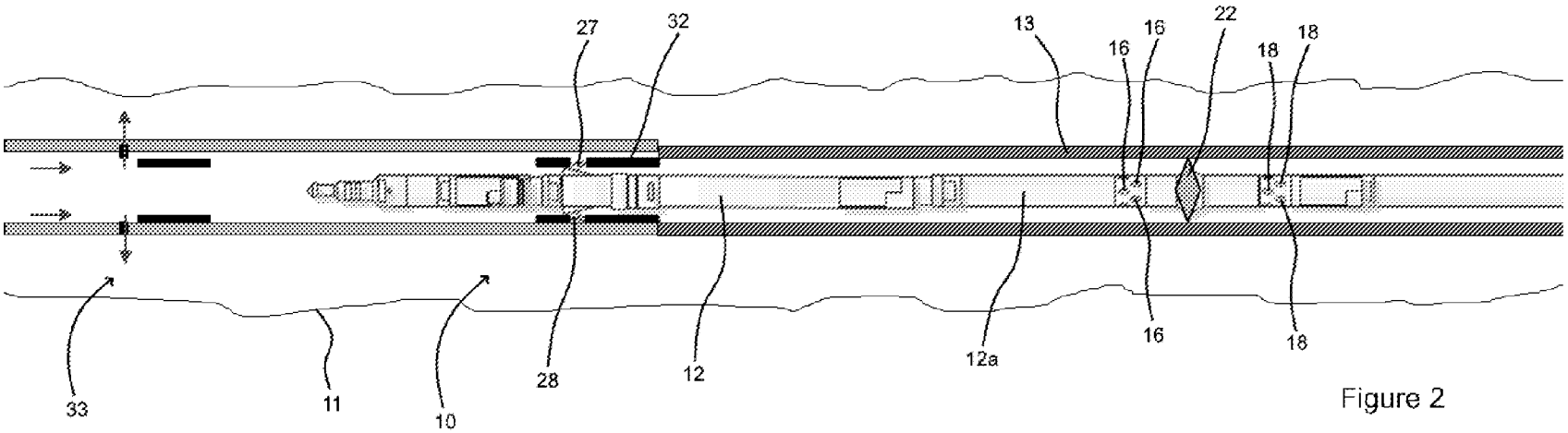
FIG. 2 is a similar view to FIG. 1, showing the apparatus after completion of method steps disclosed herein.

Referring to the drawings, apparatus 10 for signalling between downhole and uphole locations in a borehole represented schematically by numeral 11 includes a downhole tool 12 that in the illustrated embodiment is a logging tool but as mentioned may take any of a range of other forms. FIGS. 1 and 2 illustrate a logging tool in a generic manner. In practical embodiments the logging tool may be of any of a range of types, and may be a multi-purpose tool having sections intended to perform various different functions (not all or indeed any of which need be connected with logging). Equally the downhole tool may be of a dedicated type that performs only a single function.

Frequently it is a requirement of a downhole tool such as that illustrated that it effects communication from a downhole location in an uphole direction, to e.g. a surface location, when there is no direct communication connection, as would be provided by wireline, between the downhole tool and the uphole location. When the downhole tool is a logging tool as in preferred embodiments it may be of the battery-memory type mentioned above that functions autonomously following detachment and withdrawal of wireline also as described above.

Regardless of its precise design the downhole tool 12 is a rigid elongate cylinder that as shown in FIGS. 1 and 2 is contained inside hollow, rigid (typically steel) drill pipe 13. As is conventional the downhole tool is made up of a series of tool sections that are secured together in a per se known manner not requiring a detailed explanation herein. As explained herein other types of pipe alternatively may be used instead of drill pipe.

The drill pipe 13 may be of largely constant internal diameter as shown; or it may have a variable internal diameter. One way in which the latter arrangement may be effected is by connecting one or more lengths of e.g. wash pipe in series with one or more drill pipe lengths. As mentioned, moreover, the drill pipe may be entirely replaced by wash pipe although it is more likely that only a small number of pipe sections (such as one or two sections at the downhole end of the pipe) are formed as wash pipe, as is conventional in the bottom hole assembly and similar arts.

At its uphole end the Illustrated downhole tool 12 is formed with a wireline neck 15 of a per se known kind permitting releasable attachment of wireline that as explained is connected to the downhole tool during running in. The downhole tool 12 however is not limited to such an arrangement, and other types of neck (including but not limited to fishing neck types) may be provided in addition to or as alternatives to the illustrated wireline neck 15. The precise design of the downhole tool 12 will depend on its features and intended use.

The downhole tool 12 is moveable in the drill pipe 13 except at times when as described herein it is restrained against movement relative to the drill pipe 13.

Figure 3:
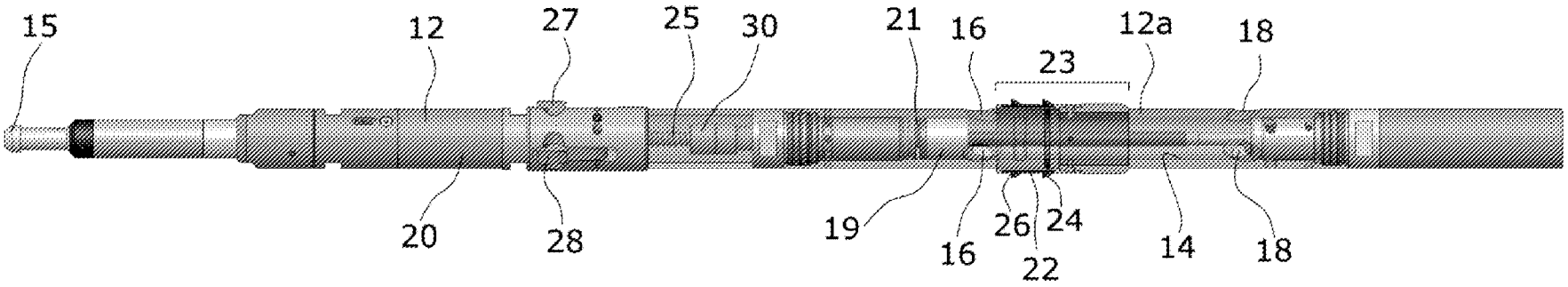
FIG. 3 shows a downhole tool that may form part of the FIG. 1/FIG. 2 apparatus, partly in phantom, illustrating a moveable valve member in a first position giving rise to an open first fluid flow path.
Figure 4:
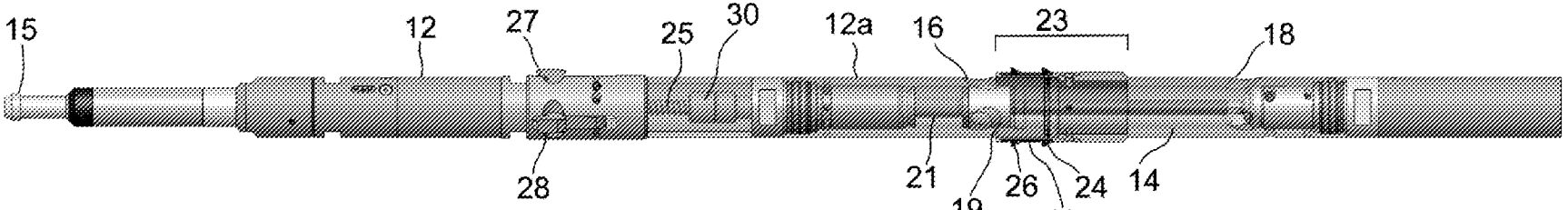
FIG. 4 is a similar view to FIG. 3, showing the moveable valve member in a second position closing the first fluid flow path.

At least one section 12*a* of the downhole tool 12 includes an elongate, cylindrical hollow interior 14 best illustrated in FIGS. 3 and 4. The hollow interior 14 extends longitudinally centrally along the tool section 12*a*.

In practical embodiments there may exist more than one section, such as section 12*a*, of downhole tool 12 having a hollow interior 14. For simplicity the remainder of this description assumes the presence of only a single such section 12*a*.

The drill pipe 13 in use is filled with a fluid schematically represented by fluid flow arrows 17 that normally is pumped in a downhole direction inside its hollow interior, circulated out of the open downhole end of the drill pipe and returned back to a surface location via the approximately annular gap between the exterior of the drill pipe 13 and the boundary of the borehole 11. Surface-located pumping systems are routinely used for this purpose. The nature and operation of such pumping systems are well known in the art.

The fluid 17 may take any of a range of forms, and may include drilling mud, fluid such as water or hydrocarbons that flows under pressure from a formation perforated by the borehole 11, chemicals intentionally added to perform a function downhole, water introduced from a surface location, mineral and other debris, and undissolved gas bubbles. The fluid 17 may be for example conducting or non-conducting, may be water-based or oil-based and may be highly saline or of low salinity as is familiar to those having knowledge of drilling engineering. Almost without fail the fluid 17 will be a complex mixture the precise make-up and properties of which are likely to vary over time and from one instance to another.

A fluid inlet, in the form of at least one and in practice typically plural apertures 16, perforates the wall of the downhole tool section 12*a* to permit communication of fluid 17 surrounding the downhole tool 12 from the exterior of the downhole tool 12 to the hollow interior 14.

A fluid outlet, in the form of at least one and in practice typically plural apertures 18, perforates the wall of downhole tool section 12*a* at a location downhole of the fluid inlet apertures 16. The fluid outlet apertures permit the flow of fluid from the hollow interior 14 of tool section 12*a* to the exterior of the downhole tool 12. The hollow interior 14 thus connects the fluid inlet 16 and the fluid outlet 18 to define a first fluid flow path. As explained below such connection may selectively be opened and closed during operation of the disclosed apparatus 10.

The apparatus 10 includes a moveable valve member in the form of a piston 19 (FIGS. 3 and 4) that is moveable longitudinally along the hollow interior 14 of the downhole tool section 12*a*.

In the illustrated embodiment the piston 19 is supported on a rod 21 that extends part of the way along the hollow interior 14 and is itself supported for stable longitudinal movement. The diameter of the piston 19 is slightly less than that of the hollow interior 14. This in combination with the stabilising effect of the rod 21 means that the piston may be caused to slide from a first position, illustrated in FIG. 3 and described further below, in which the first fluid flow path is open and a second position illustrated in FIG. 4 in which the first fluid flow path is constricted or closed. The rod 21 is connected to an actuator mechanism for the purpose of selectively effecting such movement of the piston 19.

The actuator mechanism in the illustrated embodiment includes a motor sub 20 included in the downhole tool that is arranged to cause selective rotation of a drive screw 25 drivingly received in a nut assembly 30 that causes extension and retraction, as desired, of the rod 21 in the longitudinal direction of the interior of the downhole tool. The rod 21 is at its downhole end supported in a manner permitting such movement with the result that the piston 19 may be caused selectively to move along the hollow interior 14. Such movement is apparent from comparison of FIGS. 3 and 4.

The motor 20 may be of a range of types and typically would be an electric or hydraulic motor.

As shown in FIG. 3 the piston 19 may normally be held on the rod 21 at a location slightly uphole of the fluid inlet apertures 16 whereby the first fluid flow path is open and essentially uninterrupted. The piston 19 may at times when it is required to close the first fluid flow path be moved on the rod 21 a short distance in the downhole direction to a location immediately adjacent the fluid inlet apertures 16 so as to block them and thereby prevent the flow of fluid via the first fluid flow path. The purpose of such closing is explained further below.

The moveable valve member need not adopt the piston form illustrated and may instead take a variety of other forms. As a non-limiting example in this regard one may consider a flap valve that as desired occupies or is clear of the hollow interior 14. Moreover although it is desirable that the moveable valve member is capable of completely blocking the first fluid flow path it is believed possible to construct working embodiments of the apparatus 10 in which the moveable valve member constricts the first fluid flow path, without closing it entirely.

The downhole tool 12 includes extending about its outer periphery a sealing member 22. This may form part of a seal and projection section 23 of the downhole tool 12 that is shown schematically in FIGS. 1-4 and illustrated in one embodiment in more detail in FIG. 5.

The sealing member 22 is a resiliently deformable annulus that encircles and is a tight fit on the exterior of the downhole tool 12 at a location lying intermediate the fluid inlet apertures 16 and the fluid outlet apertures 18. As needed the exterior of the downhole tool may be formed with projections and/or recesses that co-operate with the sealing member to secure it in a desired location along the length of the downhole tool 12. A non-limiting example of such an arrangement is the formation of an annular bead projecting radially inwardly from the sealing member 22 that is received in a complementary annular recess formed in the surface of the downhole tool 12 in the seal and projection section 23. Numerous other ways of securing the sealing member 22 in position are possible and will occur to the person of skill in the art. Fasteners such as clips or screws may for example be employed, as may adhesive compounds, either in replacement of or to augment a projection and recess combination described. Other combinations of retention means are also possible.

The sealing member 22 includes one or more flanges 24, 26 that are spaced from one another along the length of the sealing member 22 and that extend outwardly away from the surface of the downhole tool 12. The flanges 24, 26 are continuous, circular structures that are dimensioned such that when the downhole tool 12 is positioned in the drill pipe 13 as illustrated they engage the inner wall of the drill pipe 13 in a sealing manner that prevents the flow of fluid via the part of the exterior of the downhole tool 12 in the vicinity of and beyond the seal and projection section 23. This in turn means that any fluid flowing in a downhole direction is forced to follow the first fluid flow path when this is not closed through operation of the moveable valve member.

The sealing member 22 preferably is made from a resiliently deformable compound such as a polymer or copolymer or a composite including a polymer or copolymer. A range of polymers and copolymers is suitable for this purpose, as will be known to the person of skill in the art. Different parts of the sealing member 22 may have differing stiffnesses and other properties and may be formed as composite structures including internal and/or external reinforcing elements.

Figure 5:
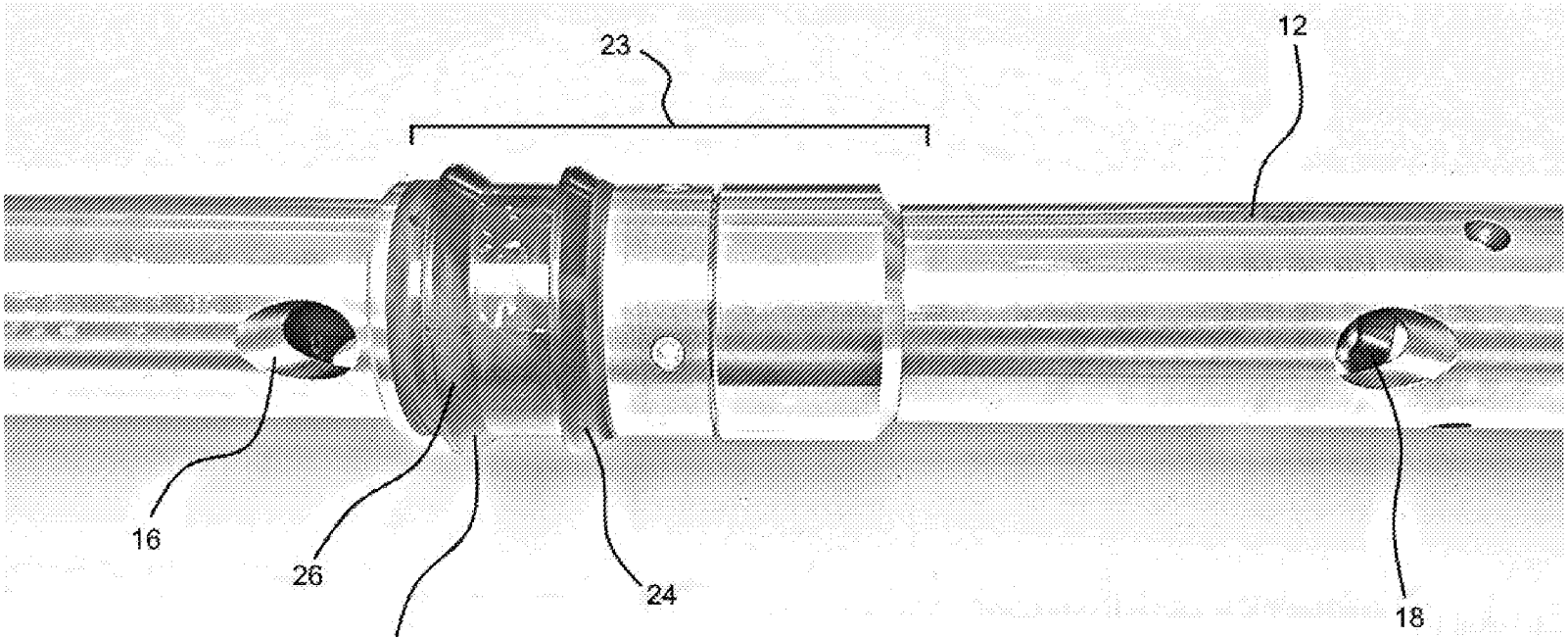
FIG. 5 shows in perspective view part of a downhole tool, illustrating a seal and projection section.

As mentioned, in FIG. 5 the sealing member 22 includes two radially outwardly extending flanges 24, 26 but this number is not mandatory. More or fewer than the illustrated number of flanges may be provided; and indeed the sealing member 22 may adopt an entirely different design that does not rely on the presence of flanges if desired, it being sufficient that the sealing member 22 substantially or entirely prevents the flow of fluid in a downhole direction via the exterior of the downhole tool 12.

The apparatus 10 includes various means for constraining the downhole tool 12, which otherwise would be moveable out of the open, downhole end of the drill pipe 13, to lie at least partially within the drill pipe 13.

If the downhole tool 21 is as described of a kind requiring conveying in a downhole direction protected inside the drill pipe 13 it is necessary during such conveying to ensure that the downhole tool 12 is recessed entirely within the drill pipe 13 in order to protect it against damage that may occur as the tool 12 is conveyed.

This is achieved in the illustrated embedment through the use of one or more latch arms 27, 28 that as shown are positioned towards the uphole end of the downhole tool 12 and are capable of selectively extending from and retracting into the downhole tool 12. On assembling of the downhole tool 12 in the drill pipe 13 ready for conveying downhole the latch arms, which may be of a per se known design, are caused to extend from the surface of the downhole tool 12 to engage in respective recesses 29, 31 formed in a latch sleeve 32.

One way of effecting movement of the latch arms 27, 28 between the retracted and extended positions is through a mechanism that is coupled to and driven by the drive screw 25. Mechanisms of this kind are known in the art and familiar to the person of skill in the art. Therefore they are not described further herein. One advantage of using the drive screw 25 to cause movement of the latch arms 27, 28 is that such movement is timed to coincide with movement of the piston 19. A timing ratio may as desired be built in to the components for example through the choice of screw thread pitch and/or the incorporation of meshing gears or similar ratio-based drive parts in the mechanism.

Other means of effecting movement of the latch arms may alternatively be employed. Examples include but are not limited to dedicated drive motors.

The latch sleeve 32 is fixed Inside the interior of the drill pipe 13 such that engagement of the latch arms 27, 28 in the recesses 29, 31 fixes the downhole tool 12 in position recessed within the drill pipe 13.

When so fixed the downhole tool 12 lies completely within the drill pipe 13. As a result extending of the drill pipe 13 in a downhole direction, in a per se known manner involving adding sections or "stands" of drill pipe sequentially at the surface termination of the borehole 11, causes the downhole tool 12 to be carried to the part of the borehole where it is required to function, in a manner protecting it against damage. Such damage otherwise probably would occur, as a result of the harsh borehole environment and the significant forces imparted to the drill pipe 13 while it is being extended along the borehole 11.

In the Illustrated embodiment the latch sleeve 32 is such as to define an optional annular gap between its exterior and the interior wall of the drill pipe 13. Such a gap is not visible in the drawings but is represented schematically by the fluid flow arrows 17 in FIG. 1 in the vicinity of the latch sleeve 32 passing close to the wall of the drill pipe 13.

Other arrangements however are possible, including designs in which the fluid may pass between protruding latch arms such as arms 27 and 28 instead of bypassing the arms via the annular gap. The annular gap arrangement however is advantageous because it minimises damage to the latch arms 27, 28 as may be caused by debris in the fluid 17.

Figure 6:
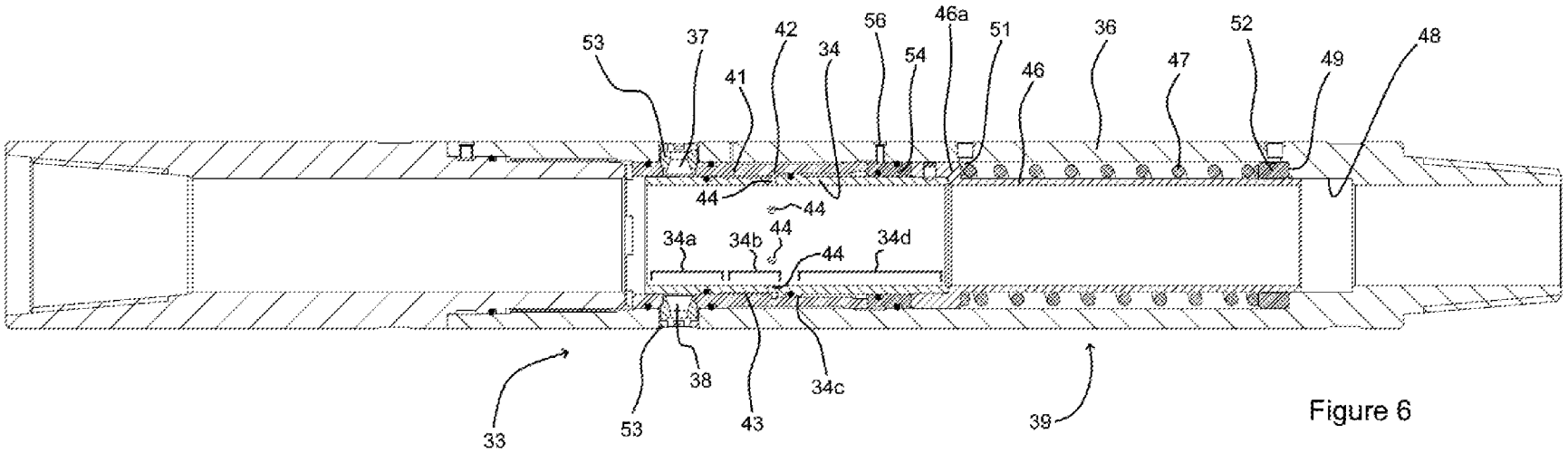
FIG. 6 shows in cross-sectional view an enlargement of drill pipe forming part of apparatus according to the disclosure, and illustrating an openable valve formed in the drill pipe.

A distance uphole of the latch sleeve 32 the drill pipe 13 includes an openable valve 33 shown in schematic form in FIGS. 1 and 2 and in more detail in FIG. 6.

Openable valve 33 consists primarily of a hollow tubular valve member 34 that is a sliding fit inside a modified length or section 36 of the drill pipe 13. The tubular valve member 34 is biased by a blasing arrangement 39 described below normally to close one or more valve apertures 37, 38 formed in and perforating the cylindrical wall of modified drill pipe section 36. The tubular valve member 34 extends for part of the length of the modified drill pipe section 36. The tubular valve member 34 is caused to move to open the valve apertures 37, 38 when pressure of fluid inside the modified drill pipe section 36 increases to a degree that overcomes the effect of the biasing arrangement 39 in maintaining the tubular valve member in a position closing the valve apertures.

The exterior dimensions of the tubular valve member 34 are not constant along its length. As a result an uphole portion 34*a* is a sliding fit relative to a liner tube 41 that is described in more detail below and is fixed so as to lie within and line the interior of the modified drill pipe section 36.

Downhole of the portion 34*a* a recessed portion 34*b* is of reduced external diameter and terminates in an outwardly directed protuberance in the form of protruding ring 34*c* that in like manner to the portion 34*a* is a sliding fit relative to the liner tube 41. Downhole of the protruding ring 34*c* the tubular valve member 34 defines a further length 34*d* that is of reduced external diameter compared with the portions 34*a* and 34*c*. The further portion 34*d* extends for the remainder of the length of the tubular valve member 34 to its downhole termination.

The liner tube 41 is of constant internal diameter over approximately half its length at the uphole end; and of enlarged internal diameter over the remainder of its length defining a space between the liner tube 41 and the tubular valve member 34. The liner tube thus defines an inwardly directed protuberance in the form of a shoulder 42 that when the openable valve 33 is closed lies opposite and slightly uphole of the protruding ring 34*c*. As a result the shoulder 42, protruding ring 34*c* and the overlap of section 34*b* with the constant internal diameter section of the liner tube 41 define an essentially closed, annular chamber 43. A number of o-ring seals are provided received in recesses as Illustrated and ensure the fluid-tightness of the boundaries of the annular chamber 43.

The tubular member 34 is perforated in an annular region lying adjacent the shoulder 42 and the protruding ring 34*c* by an annular series of through-going apertures 44. The apertures 44 permit fluid pressure inside the tubular valve member 34 to act in the closed annular chamber 43.

The tubular valve member 34 is open at each end. The in-use downhole end of the tubular valve member 34 is received in the open upper end of a hollow, open-ended spring core tube 46 that forms part of the biasing arrangement 39. Spring core tube 46 terminates at its uphole end in a cup section 46*a* of relatively large internal and external diameters that accommodates the downhole end of the tubular valve member and is a sliding fit inside the modified drill pipe section 36.

Downhole of the cup section the spring core tube 46 is of reduced internal and external diameter. A coiled spring 47 encircles the spring core tube 46 over the major part of its length and lies between the spring core tube 46 and the interior wall of the drill pipe section 36. At the downhole end of the coil spring 47 the modified drill pipe section 36 defines a reduced internal diameter portion 48 that presents an upwardly facing shoulder 49. The coiled spring 47 acts between the upwardly facing shoulder 49 and a downwardly facing shoulder 51 defined by the underside of the cup section 46*a*.

At least one optional spacer ring 52 may be provided to encircle the spring core tube 46 at its lowermost end and transfer force between the spring 47 and the upwardly directed shoulder 49. The number and dimensions of the spacer ring provision may be varied in order to adjust the degree of pre-load of the coiled spring 47 as further described below. A similar spacer ring arrangement may be provided in addition or as an alternative at the uphole end of the spring 47.

The spring core tube 46 constrains the coiled spring 47 to retain a cylindrical shape and protects the coiled spring 47 against damage that might otherwise be caused by the flow of fluid in the modified drill pipe section 36.

The liner tube 41 as noted is fixed relative to the modified drill pipe section 36 and is radially perforated to define one or more, and in practice an annular series of, valve apertures 37, 38. Each of the valve apertures 37, 38 forms part of a respective second fluid flow path and is lined by a respective nozzle 53. The nozzles 53 extend radially relative to the longitudinal axis of the modified drill pipe section 36 and are supported by the liner tube 41. The nozzles 53 are shaped to produce desired flow characteristics when fluid flows via the second fluid flow paths as described below.

When as illustrated in FIG. 6 the openable valve 33 is closed the coiled spring 47 urges the cup section 46*a* of spring core tube 46 into engagement with a fixing ring 54 secured e.g. using one or more screws 56 adjacent the downhole end of the liner tube 41. Any Increase in fluid pressure inside the modified drill pipe section 36 however acts via the through-going apertures 44 and pressurises the annular chamber 43. This urges the inwardly directed shoulder 42 and the protruding ring 34*c* apart from one another with the consequence that if the fluid pressure increase is sufficient the tubular valve member 34 is driven in a downhole direction against the effect of the biasing arrangement 39 and in particular the coiled spring 47.

This effect arises when the pressure of fluid inside the modified drill pipe section 36 exceeds a threshold that is equivalent to the force applied by the spring 47. The spring is pre-loaded by the spacer ring 52. The insertion of further spacer rings, that may be the same as that visible in FIG. 6 or may be of differing designs, optionally adds to the pre-load with the consequence that a higher pressure increase then is required to open the openable valve 33.

As is apparent in FIG. 6 the tubular valve member 34 and the spring core tube 46 present an essentially constant internal diameter of their contiguous hollow interiors. This is desirable in order to confer good fluid dynamic characteristics on the interior of the modified drill pipe section 36, However in other embodiments a non-constant internal diameter may be desired and such arrangements lie within the scope of the disclosure.

Figure 7:
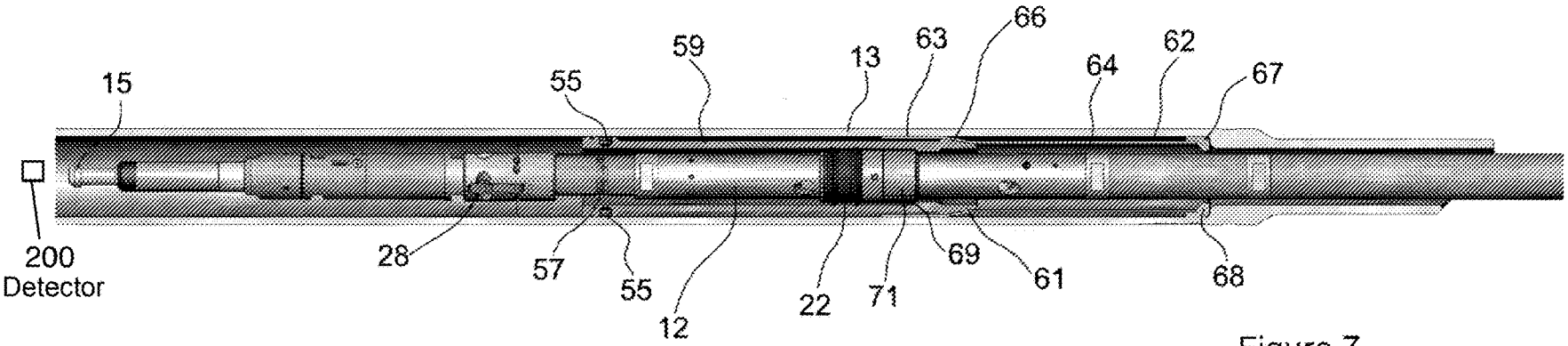
FIG. 7 is a partly sectioned view showing further embodiments, including a number of optional features.

As illustrated in FIG. 7 the drill pipe 13 supports one or more sensor elements that in the preferred embodiment illustrated are magnets 55. In the illustrated embodiment two such magnets 55 are visible at diametrically opposite locations on the interior wall of the uphole end of a rigid, hollow, cylindrical swage member 59 the nature and operation of which are described further below. In other embodiments more or fewer than the two illustrated magnets 55 may be provided, for example in a circular array extending about the inside surface of the swage member.

The swage member 59 is positioned inside the drill pipe 13 before deployment of the downhole tool 12 occurs, and typically would be assembled in position as illustrated before the length 13 of drill pipe supporting it is run in to the borehole 11. As a result the magnets 55 are pre-located near to the downhole end of the drill pipe string, and are detectable on correct deployment of the downhole tool 12 by one or more sensors 57 that generate signals to signify such deployment.

As noted the sensor(s) preferably is/are Hall-effect devices supported as part of the downhole tool 12 when the sensor elements as is preferred are embodied as magnets 55. The Hall-effect sensors 57 are secured close to or on the exterior of the downhole tool 12 such that they efficiently couple the magnetic fields of the magnets 55 and generate signals on deployment of the downhole tool 12 with part of it protruding from the open end of the drill pipe string ready for use. The signals generated by the sensors 57 give rise to commands causing movement of the piston 19 on the shaft 21 and thereby generate an uplink signal indicating the deployment status of the downhole tool 12.

Additionally or alternatively a similar arrangement may be provided to signal when incorrect deployment of the downhole tool has occurred.

At its end lying downhole of the magnets 55 the external circumference of the swage member 59 is formed as a downwardly extending taper 61 that is received inside a swage element in the form of a deformable, hollow tube 62. The taper 61 may be hardened or may be formed of an alloy that is otherwise resistant to deformation. The deformable tube 62 is formed of a rigid material that nonetheless is of lesser hardness than the taper 61.

An uphole end 63 of the deformable tube 62 is of larger internal and external diameter than the remainder 64 of the length of the deformable tube 62. A steady taper 66 interconnects the large-diameter, uphole end and the reduced diameter remainder of the deformable tube 62. The angle of the taper 66 is the same as or similar to that of taper 61. The exterior of taper 61 abuts the interior surface of taper 66 when the drill pipe 13 of FIG. 7 is assembled.

Near its downhole end the interior of drill pipe 13 is formed to include an inwardly projecting shoulder 67 that in the illustrated embodiment is annular, although in other embodiments need not extend all the way around the interior of the drill pipe 13. The downhole, open end of the deformable tube 62 bears against the shoulder 67. An optional bearing ring 68 is shown in FIG. 7 interposed between the deformable tube 62 and the shoulder 67.

A short distance uphole from the taper 61 the interior surface of the deformable tube 62 includes an inwardly projecting landing ring 69. The dimensions of this are such as to be engageable by an outwardly projecting landing ring 71 formed on or secured to the exterior of the downhole tool 12 part-way along its length. The landing ring 71 and the length of the swage member 59 are such that the landing ring 71 engages the landing ring 69 when the downhole tool is deployed protruding partly from the open end of the drill string and the Hall-effect sensor(s) is/are in register with the magnets 55.

On deployment of the downhole tool 12 from a position entirely retracted within the drill pipe 13 to a position partly protruding therefrom as illustrated the landing ring 71 engages the landing ring 69 in a manner limiting movement of the downhole tool 12 out of the drill string. This occurs simultaneously with alignment in register with one another of the magnets 55 and the Hall effect sensor(s) 57 causing generation of one or more signals indicating deployment of the downhole tool 12. As noted such signals in turn initiate a signalling regime as further described herein.

If the downhole tool 12 on landing in this manner possesses kinetic energy in excess of a threshold determined by the hardness of the metal of the deformable tube 62 the taper 61 causes the taper 66 to travel along the deformable tube. This swaging of the deformable tube dissipates the excess kinetic energy of the downhole tool 12.

The length of the deformable tube 62 is chosen to accommodate plural landings of the downhole tool 12 as described, with the taper 66 moving along a proportion of the length of the deformable tube 62 each time. The deformable tube 62 therefore is useable multiple times. FIG. 7 shows the position of the taper 66 after for example one or two prior landings of the downhole tool 12.

In use of the apparatus disclosed herein a downhole tool 12, such as a logging tool, is assembled as illustrated in FIG. 1 with all of the downhole tool 12 recessed within drill pipe. Depending on the length of the downhole tool 12 it may be the case that a relatively short length of it lies within the modified drill pipe section 36 with most of the downhole tool length received within one or more further, conventional drill pipe stands 58 that are secured downhole of the modified drill pipe section 36. Equally, depending on the length of the downhole tool 12, it may not be necessary to provide the further drill pipe stands 58.

The downhole tool 12 is fixed in position inside the drill pipe through deployment of the latch arms 27, 28 when these are aligned with the recesses 29, 31 formed in the latch sleeve 32. In this regard more or fewer than the two visible latch arms 27, 28 and the two recesses 29, 31 may be provided.

When the downhole tool 12 is so fixed the sealing member 22 defines a fluid-tight, slideable seal between the exterior of the downhole tool and the interior of the drill pipe 58. At this time if the downhole tool is e.g. a wireline-compatible logging tool, wireline is connected to the wireline neck 15 that defines a releasable connection via which power, commands and data may pass at a high data rate between uphole and downhole locations and vice versa. The wireline reaches the inside of the drill pipe string via a side entry sub in a conventional manner. The side entry sub is omitted from the drawings for simplicity.

The downhole tool 12 then is conveyed in a downhole direction recessed within the drill pipe 36, 58 through a process of adding stands of drill pipe at the surface end of the drill pipe string. The wireline is paid out from its storage drum as this process takes place.

Depending on the precise requirement the drill string typically will be circulated with fluid 17 during the progress in a downhole direction. As explained during such circulation the fluid 17 usually is pumped, using one or more surface-located pumps. In a downhole direction inside the drill pipe.

As signified by the arrows 17 in the vicinity of the downhole tool 12 the fluid flows in the space between the latch sleeve 32 and the inner surface of the modified drill pipe section 36. It then flows along the drill pipe 58 between its inner surface and the downhole tool 12 until the sealing member 22 prevents further downhole progress of the fluid along the exterior of the downhole tool 12.

At this time the piston 19 occupies a position corresponding to an open state of the first fluid flow path. In consequence the fluid 17 flows via the fluid inlets 16 into and along the hollow interior 14 of the downhole tool 12 before exiting to the exterior of the downhole tool 12 once again via the fluid outlets 18, downhole of the sealing member 22. The fluid 17 then is free to flow out of the downhole end of the drill pipe 58 for recirculation to the surface pumping equipment via the gap defined between the drill pipe and the borehole 11.

At the end of the described conveyance process the downhole tool 12 is in the vicinity of the total depth of the borehole, the term "total depth" being familiar in the downhole engineering art and not requiring explanation herein; or another location in the borehole at which it is required for the downhole tool 12 to operate.

At this point a command may be sent using the connected wireline to cause deployment of the downhole tool 12 to an operative position. Such a command causes an actuator mechanism, that may be as described above, to effect retraction of the latch arms 27, 28 from the latch recesses 29, 31. This frees to the downhole tool 12 to move as needed along the inside of the drill pipe.

The pressure of pumped fluid 17 acting inside the drill pipe pumps the downhole tool 12 in a downhole direction such that part of the downhole tool 12 extends out of the open end of the drill pipe 58 as illustrated in FIG. 7. If as explained the retraction of the latch arms 27, 28 is such as to coincide with movement of the piston 19 the force with which pumping of the downhole tool 12 occurs increases during retraction of the latch arms 37, 38, as the piston 19 closes off the fluid inlets 16.

Protrusion of the downhole tool is limited when a no-go defined in part by the projection section 23 of the downhole tool 12 and in particular the landing ring 71 engages a further projection, that is exemplified in a non-limiting manner by landing ring 69, or another landing ring of a kind familiar in the art, protruding inwardly from the interior surface of a section of drill pipe downhole of that illustrated in FIG. 1.

As necessary during such landing excess kinetic energy of the downhole tool 12 resulting from its movement is dissipated, without causing damage, through the described action of the swage element 64 and in particular travel of the taper 66 in a downhole direction as a result of pressing by the taper 61.

At the end of this process the sensor elements (that as explained are magnets 55 in a typical apparatus) will be aligned with the one or more sensors 57 that generate a signal indicative of correct deployment of the downhole tool 12 to its operative position partly protruding from the lowermost stand of drill pipe 58.

This signal may be transmitted via connections in the drill pipe and/or the downhole tool 12 for transmission via the wireline. Surface-located processing equipment, a human operator or, conceivably, one or more processors at the downhole location, may then generate a command sequence that:

a) as needed, activates a mechanism (if provided) for locking the downhole tool in position;
b) disconnects the wireline from the wireline neck; and
c) causes winding of the wireline back on to its storage drum, with the wireline exiting the drill pipe via the side entry sub and being completely withdrawn from the borehole in order to avoid fouling with operative equipment such as rotating drill pipe.

At this point there is no longer any prospect of electrical or electronic communication between the downhole tool 12 and any surface-located equipment or vice-versa. It is necessary however to signify to the surface equipment that correct deployment of the downhole tool 12 has occurred.

This is achieved by closing of the first fluid flow path. In turn this results from movement of the piston 19 in a downhole direction to close off or at least constrict the fluid inlets 16. This movement may be initiated by e.g. a wireline command as described above, a downlink drill pipe rotation command or a downlink pressure pulse signal.

Such closing or constriction of the first fluid flow path causes pressure of the fluid 17 uphole of the fluid inlets 16 to rise rapidly, and generate signals in the drill pipe that are exemplified in FIGS. 7 and 8 and are explained below.

This pressure acts via the apertures 44 and in turn causes pressure in the annular chamber 43 to rise to a level exceeding the bias effected by the spring 47 forming part of the biasing arrangement 39. The tubular valve member 34 is then driven in a downhole direction, opening the openable valve by uncovering the apertures 37, 38 and any other apertures as may form part of the openable valve.

This causes the fluid pressure within the modified drill pipe section 36 to vent via the second fluid flow path defined by the apertures 37, 38 and generate a high-amplitude, and highly characteristic, increase in the pressure of fluid inside the drill pipe. The venting of fluid pressure via the apertures 37, 38 prevents damage from occurring to the components of the apparatus while allowing the pressure increase to be an unambiguous indicator of correct deployment even in a losing or gaining well as described above.

The resulting pressure pulse propagates rapidly in an uphole direction to surface-located pressure detecting equipment where it readily is decoded as an indication of correct deployment of the downhole tool.

Operation of the downhole tool 12, e.g. to commence logging operations (or other operations if appropriate) may then be commanded using available downlink communications methods such as but not limited to drill pipe rotation, downlink pressure pulse generation or in some cases the pumping of a messenger sub that interacts with the downhole tool 12 to initiate its activity.

Figure 8:
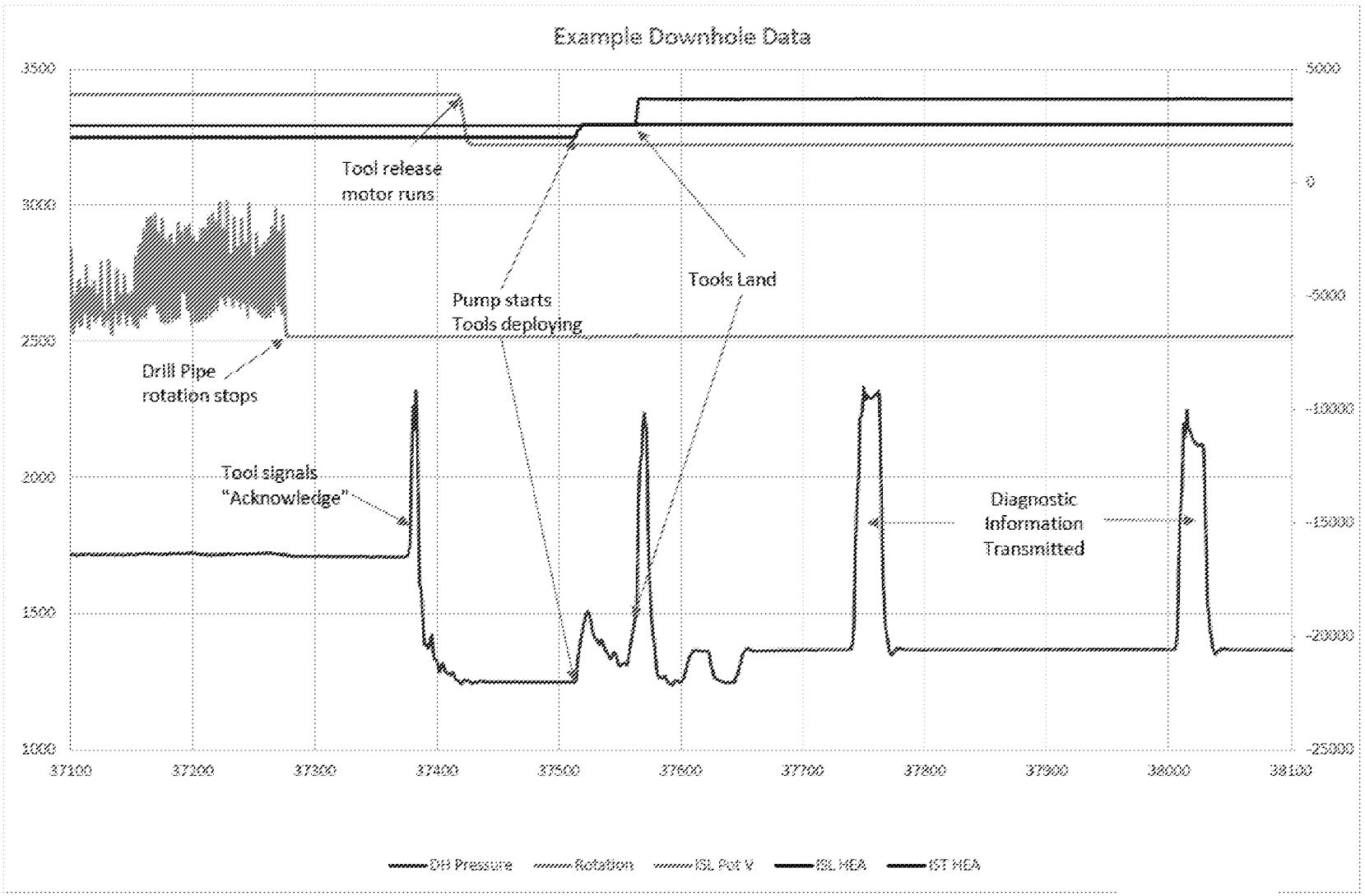
FIG. 8 is an annotated plot of pressure, rotational motion and sensor outputs detected in the vicinity of the downhole tool during deployment operations.
Figure 9:
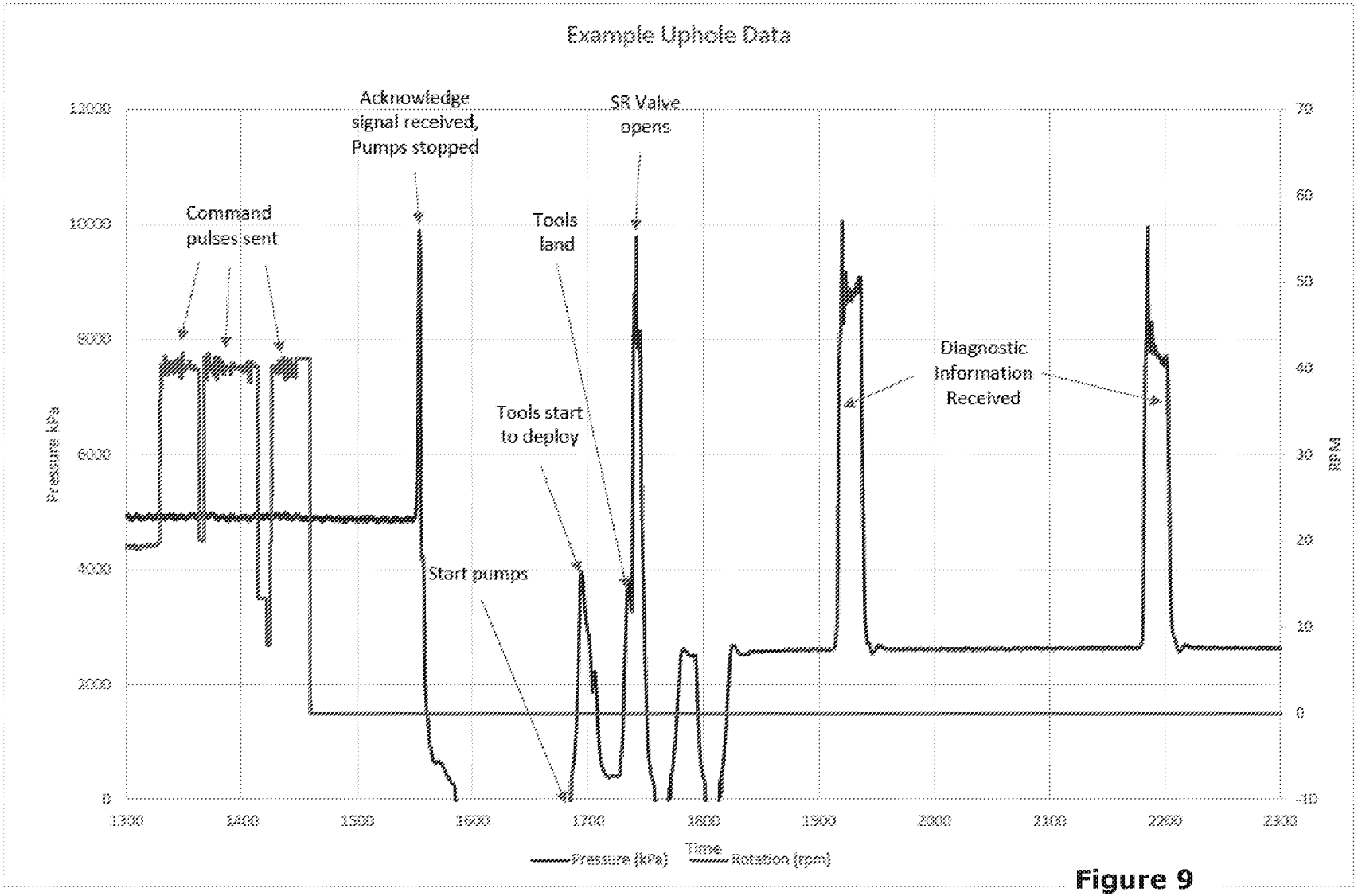
FIG. 9 is an annotated plot that is similar to FIG. 8 illustrating the signals generated at a surface location while the operations represented in FIG. 8 take place.

Examples of downhole pressure and sensor voltage signals are illustrated in FIG. 8 and examples of the uplink communications pressure pulse described above in FIG. 9. These are exemplary, non-limiting signal plots that have been annotated in order to explain the various artefacts that are apparent. The annotations are self-explanatory. FIGS. 7 and 8 in addition to showing examples of pressure signals generated and detected in order to signify correct tool deployment in the downhole location also show in a non-limiting manner the generation and detection of signals indicative of diagnostic information transmission, as labelled. Such signal generation may be effected in a similar manner to that described above and may readily be envisaged.

The apparatus and method of the invention amount to significant improvements in the nature, bandwidth and reliability of uplink communications from a downhole tool to uphole equipment.

Modifications of the apparatuses and methods described herein as would occur to the person of skill in the art are within the scope of the disclosure hereof.

The listing or discussion of an apparently prior-published document in this specification should not necessarily be taken as an acknowledgement that the document is part of the state of the art or is common general knowledge.

Preferences and options for a given aspect, feature or parameter of the invention should, unless the context indicates otherwise, be regarded as having been disclosed in combination with any and all preferences and options for all other aspects, features and parameters of the invention.

The invention claimed is:

1. Apparatus for signalling between downhole and uphole locations in a borehole comprising:

a downhole tool having:

a hollow interior;

a fluid inlet;

a fluid outlet that is connectable to the fluid inlet to define a first fluid flow path via the hollow interior; and a moveable valve member that is capable of selectively opening and constricting or closing the first fluid flow path, wherein the moveable valve member is moveable within the hollow interior between a valve open position in which the first fluid flow path is open and a valve closed position in which the first fluid flow path is constricted or closed;

pipe within which at least part of the downhole tool is moveably located, the downhole tool being peripherally sealed to an interior of the pipe in a manner preventing fluid flow in the pipe via part of an exterior of the downhole tool;

the downhole tool being constrained to lie at least partially within the pipe; and the pipe including an openable valve uphole of the downhole tool and permitting flow of fluid from the interior of the pipe via at least one second fluid flow path interconnecting the interior of the pipe and an outside, wherein the openable valve is normally closed;

wherein when the moveable valve member constricts or closes the first fluid flow path fluid pressure in the pipe increases to generate a signal in the pipe and cause opening of the openable valve and venting of pressurised fluid from within the pipe to the outside via the at least one second fluid flow path;

wherein the at least one second fluid flow path is or includes one or more apertures that perforate a wall of the pipe.

2. The apparatus according to claim 1 wherein the downhole tool is or includes a logging tool.

3. The apparatus according to claim 1 wherein the fluid inlet and the fluid outlet are respective apertures that are spaced from one another along a length of the downhole tool and that each perforate a wall of the downhole tool whereby the hollow interior interconnects the fluid inlet and the fluid outlet.

4. The apparatus according to claim 1 wherein the fluid inlet in use lies uphole of the fluid outlet.

5. The apparatus according to claim 1 wherein the moveable valve member is or includes a piston that is moveable in the hollow interior between a valve open position in which it is spaced from the fluid inlet; and a valve closed position in which the piston lies adjacent to and constricts or closes the fluid inlet.

6. The apparatus according to claim 1 wherein the moveable valve member is or includes a piston that is moveable in the hollow interior between the valve open position in which it is spaced from the fluid inlet; and the valve closed position in which the piston lies adjacent to and constricts or closes the fluid inlet, the apparatus including one or more actuators for effecting movement of the piston between the valve open position and the valve closed position when the downhole tool protrudes partially from the pipe.

7. The apparatus according to claim 6, wherein the one or more actuators include an electric or hydraulic motor that responds to a detected tool status.

8. The apparatus according to claim 1 wherein the downhole tool includes extending about its exterior at least one sealing member that effects a fluid-proof seal between the downhole tool and the interior of the pipe.

9. The apparatus according to claim 1 wherein the downhole tool includes extending about its exterior at least one sealing member that effects a fluid-proof seal between the downhole tool and the interior of the pipe and wherein the at least one sealing member permits movement of the downhole tool along the pipe.

10. The apparatus according to claim 1 wherein the interior of the pipe includes one or more inwardly directed projections and the downhole tool includes one or more outwardly directed projections that are engageable with said one or more inwardly directed projections, and wherein mutual engagement of the inwardly and outwardly directed projections constrains the downhole tool to lie partially within the pipe with a length of the downhole tool protruding from the pipe in a downhole direction.

11. The apparatus according to claim 1 wherein the interior of the pipe includes one or more inwardly directed projections and the downhole tool includes one or more outwardly directed projections that are engageable with said one or more inwardly directed projections, wherein mutual engagement of the inwardly and outwardly directed projections constrains the downhole tool to lie partially within the pipe with a length of the downhole tool protruding from the pipe in a downhole direction; wherein each of the one or more inwardly directed projections is or includes an annular projection secured to and protruding inwardly from an interior surface of the pipe; and wherein each of the one or more outwardly directed projections is or includes an annular projection secured to and protruding outwardly from an outer surface of the downhole tool and being located uphole of the one or more inwardly directed annular projections, the one or more outwardly directed annular projections being too large to pass through the one or more inwardly directed annular projections on movement of the downhole tool in a downhole direction causing the one or more inwardly directed annular projections to approach the one or more outwardly directed annular projections.

12. The apparatus according to claim 1 wherein the interior of the pipe includes one or more inwardly directed projections and the downhole tool includes one or more outwardly directed projections that are engageable with said one or more inwardly directed projections, wherein mutual engagement of the inwardly and outwardly directed projections constrains the downhole tool to lie partially within the pipe with a length of the downhole tool protruding from the pipe in a downhole direction; and the apparatus including one or more shock absorbing elements that are retained relative to the downhole tool in a region between the one or more outwardly directed projections and the one or more inwardly directed projections thereby permitting indirect engagement between the one or more inwardly directed and outwardly directed projections in order to buffer impulses arising on mutual approach of the one or more inwardly and outwardly directed projections during movement of the downhole tool in a downhole direction.

13. The apparatus according to claim 1 wherein the interior of the pipe includes one or more inwardly directed projections and the downhole tool includes one or more outwardly directed projections that are engageable with said one or more inwardly directed projections, wherein mutual engagement of the inwardly and outwardly directed projections constrains the downhole tool to lie partially within the pipe with a length of the downhole tool protruding from the pipe in a downhole direction; the apparatus including one or more shock absorbing elements that are retained relative to the downhole tool in a region between the one or more outwardly directed projections and the one or more inwardly directed projections thereby permitting indirect engagement between the one or more inwardly directed and outwardly directed projections in order to buffer impulses arising on mutual approach of the one or more inwardly and outwardly directed projections during movement of the downhole tool in a downhole direction; and wherein the one or more shock absorbing elements encircle the downhole tool in a region between the one or more inwardly directed projections and the one or more outwardly directed projections.

14. The apparatus according to claim 13 wherein the one or more shock absorbing elements are or include a deformable tube that encircles the downhole tool.

15. The apparatus according to claim 13 wherein the one or more shock absorbing elements include a swage element that lies externally of the downhole tool; and wherein the apparatus includes a swage member that is fixable relative to the downhole tool and is moveable in engagement with the swage element on movement of the downhole tool beyond a predetermined position in a manner dissipating kinetic energy of the downhole tool.

16. The apparatus according to claim 13 wherein the one or more shock absorbing elements include a swage element that lies externally of the downhole tool; wherein the apparatus includes a swage member that is fixable relative to the downhole tool and is moveable in engagement with the swage element on movement of the downhole tool beyond a predetermined position in a manner dissipating kinetic energy of the downhole tool; and wherein the swage element is or includes a tube that encircles the downhole tool.

17. The apparatus according to claim 1 wherein the openable valve includes a moveable tubular valve member that lies within the pipe and a biasing arrangement that causes the tubular valve member normally to close each of the at least one second fluid flow path.

18. The apparatus according to claim 17 wherein the biasing arrangement includes an inwardly directed valve bias projection that protrudes inwardly from a wall of the pipe at a location downhole of the tubular valve member; and a hollow spring extending between the inwardly directed valve bias projection and a location uphole thereof whereby the hollow spring acts on the tubular valve member and biases it to a position closing each of the at least one second fluid flow path.

19. The apparatus according to claim 1 wherein the openable valve includes a moveable tubular valve member that lies within the pipe and a biasing arrangement that causes the tubular valve member normally to close each of the at least one second fluid flow path; and wherein the biasing arrangement includes an inwardly directed valve bias projection that protrudes inwardly from a wall of the pipe at a location downhole of the tubular valve member; a hollow spring extending between the inwardly directed valve bias projection and a location uphole thereof whereby the hollow spring acts on the tubular valve member and biases it to a position closing each of the at least one second fluid flow path; and a spring core tube lying inside and supporting the hollow spring.

20. The apparatus according to claim 1 wherein the openable valve includes a moveable tubular valve member that lies within the pipe and a biasing arrangement that causes the tubular valve member normally to close each of the at least one second fluid flow path; wherein the biasing arrangement includes an inwardly directed valve bias projection that protrudes inwardly from a wall of the pipe at a location downhole of the tubular valve member; the apparatus including a hollow spring extending between the inwardly directed valve bias projection and a location uphole thereof whereby the hollow spring acts on the tubular valve member and biases it to a position closing each of the at least one second fluid flow path; and a spring core tube lying inside and supporting the hollow spring; wherein the tubular valve member and the spring core tube define respective hollow interiors, wherein sizes of the hollow interiors permit passage of the downhole tool within and along the tubular valve member and the spring core tube.

21. The apparatus according to claim 1 wherein the openable valve includes a moveable tubular valve member that lies within the pipe and a biasing arrangement that causes the tubular valve member normally to close each of the at least one second fluid flow path and the apparatus includes a space between the tubular valve member and the pipe, the space being bounded at either end respectively by an inwardly directed protuberance protruding towards the interior of the pipe and an outwardly directed protuberance protruding from the tubular valve member whereby to define an essentially closed chamber, the tubular valve member being perforated in a vicinity of the space whereby fluid pressure acting within the tubular valve member acts on the inwardly and outwardly directed protuberances to urge them apart from one another and cause movement of the tubular valve member to open the openable valve.

22. The apparatus according to claim 1 wherein the openable valve includes a moveable tubular valve member that lies within the pipe and a biasing arrangement that causes the tubular valve member normally to close each of the at least one second fluid flow path and the apparatus includes a space between the tubular valve member and the pipe, the space being bounded at either end respectively by an inwardly directed protuberance protruding towards the interior of the pipe and an outwardly directed protuberance protruding from the tubular valve member whereby to define an essentially closed chamber, the tubular valve member being perforated in a vicinity of the space whereby fluid pressure acting within the tubular valve member acts on the inwardly and outwardly directed protuberances to urge them apart from one another and cause movement of the tubular valve member to open the openable valve and wherein the space is annular and the inwardly directed and outwardly directed protuberances are shaped accordingly.

23. The apparatus according to claim 1 wherein the openable valve includes a moveable tubular valve member that lies within the pipe and a biasing arrangement that causes the tubular valve member normally to close each of the at least one second fluid flow path and the apparatus includes a space between the tubular valve member and the pipe, the space being bounded at either end respectively by an inwardly directed protuberance protruding towards the interior of the pipe and an outwardly directed protuberance protruding from the tubular valve member whereby to define an essentially closed chamber, the tubular valve member being perforated in a vicinity of the space whereby fluid pressure acting within the tubular valve member acts on the inwardly and outwardly directed protuberances to urge them apart from one another and cause movement of the tubular valve member to open the openable valve; wherein the inwardly directed and outwardly directed protuberances are shaped so that the space is annular; and wherein the tubular valve member includes plural perforations defining an annular pattern that corresponds to the annular shape of the space.

24. The apparatus according to claim 1 wherein the openable valve includes a moveable tubular valve member that lies within the pipe and a biasing arrangement that causes the tubular valve member normally to close each of the at least one second fluid flow path and the apparatus includes a space between the tubular valve member and the pipe, the space being bounded at either end respectively by an inwardly directed protuberance protruding towards the interior of the pipe and an outwardly directed protuberance protruding from the tubular valve member whereby to define an essentially closed chamber, the tubular valve member being perforated in a vicinity of the space whereby fluid pressure acting within the tubular valve member acts on the inwardly and outwardly directed protuberances to urge them apart from one another and cause movement of the tubular valve member to open the openable valve, the apparatus including a liner tube extending between the tubular valve member and the pipe, the space being defined between the tubular valve member and the liner tube and the liner tube supporting one or more nozzles each forming part of a second fluid flow path of the at least one second fluid flow path.

25. The apparatus according to claim 1 wherein the apparatus includes or supports one or more sensor elements that are secured relative to the pipe and wherein the downhole tool includes one or more sensors, the one or more sensors detecting the one or more sensor elements on movement of the downhole tool to a deployed location and generating one or more signals indicative of such movement of the downhole tool.

26. The apparatus according to claim 25, wherein the one or more signals generated by the one or more sensors give rise to commands causing movement of the moveable valve member.

27. The apparatus according to claim 1 including at an uphole location one or more detectors of a pressure pulse that arises at a time of venting of pressurised fluid from within the pipe to the outside via each of the at least one second fluid flow path, the one or more detectors generating one or more signals indicative of such a pressure pulse.

28. The apparatus according to claim 1 including at an uphole location one or more detectors of a pressure pulse that arises at a time of venting of pressurised fluid from within the pipe to the outside via each of the at least one second fluid flow path, the one or more detectors generating one or more signals indicative of such a pressure pulse and wherein the uphole location is a surface location.

29. The apparatus according to claim 1 wherein the apparatus includes or supports one or more sensor elements that are secured relative to the pipe and wherein the downhole tool includes one or more sensors, the one or more sensors detecting the one or more sensor elements on movement of the downhole tool to a deployed location and generating one or more signals indicative of such movement of the downhole tool, the apparatus including one or more processors for processing the one or more signals generated by the one or more sensors and generating one or more control commands based on the one or more signals.

30. The apparatus according to claim 1 wherein the apparatus includes or supports one or more sensor elements that are secured relative to the pipe and wherein the downhole tool includes one or more sensors, the one or more sensors detecting the one or more sensor elements on movement of the downhole tool to a deployed location and generating one or more signals indicative of such movement of the downhole tool, the apparatus including one or more processors for processing the one or more signals generated by the one or more sensors and generating one or more control commands based on the one or more signals and wherein the downhole tool is configured to respond to the one or more control commands by one or more of initiating an action, continuing the action, ceasing the action and/or modifying the action.

31. The apparatus according to claim 1 wherein the apparatus includes or supports one or more sensor elements that are secured relative to the pipe and wherein the downhole tool includes one or more sensors, the one or more sensors detecting the one or more sensor elements on movement of the downhole tool to a deployed location and generating one or more signals indicative of such movement of the downhole tool, the apparatus including one or more processors for processing the one or more signals generated by the one or more sensors and generating one or more control commands based on the one or more signals and wherein the downhole tool is configured to respond to the one or more control commands by one or more of initiating an action, continuing the action, ceasing the action and/or modifying the action; and wherein the action is selected from a list including deploying one or more deployable components; commencing logging activity; terminating logging activity; adjusting a parameter of logging activity; processing one or more signals resulting from logging activity; requesting diagnostic information and/or responding to one or more requests for diagnostic information.

32. The apparatus according to claim 1 wherein the apparatus includes or supports one or more sensor elements that are secured relative to the pipe and wherein the downhole tool includes one or more sensors, the one or more sensors detecting the one or more sensor elements on movement of the downhole tool to a deployed location and generating one or more signals indicative of such movement of the downhole tool; the apparatus including one or more processors for processing the one or more signals generated by the one or more sensors and generating one or more indications based on the one or more signals.

33. The apparatus according to claim 1 wherein the apparatus includes or supports one or more sensor elements that are secured relative to the pipe and wherein the downhole tool includes one or more sensors, the one or more sensors detecting the one or more sensor elements on movement of the downhole tool to a deployed location and generating one or more signals indicative of such movement of the downhole tool; the apparatus including one or more processors for processing the one or more signals generated by the one or more sensors and generating one or more indications based on the one or more signals; and wherein the one or more indications include one or more selected from a list including an indication of deployment of the downhole tool; an indication of failure of the downhole tool to deploy; and/or diagnostic information received from the downhole tool.

34. The apparatus according to claim 1 wherein the apparatus includes or supports one or more sensor elements that are secured relative to the pipe and wherein the downhole tool includes one or more sensors, the one or more sensors detecting the one or more sensor elements on movement of the downhole tool to a deployed location and generating one or more signals indicative of such movement of the downhole tool; the apparatus including one or more processors for processing the one or more signals generated by the one or more sensors and generating one or more indications based on the one or more signals, the apparatus including one or more display devices for displaying the one or more indications.

35. A method of using an apparatus to signal between downhole and uphole locations in a borehole, the method comprising:

conveying to a downhole location inside a pipe a downhole tool having a hollow interior; a fluid inlet; a fluid outlet that is connectable to the fluid inlet to define a first fluid flow path via the hollow interior; and a moveable valve member that is capable of selectively opening and constricting or closing the first fluid flow path, the moveable valve member moveable within the hollow interior between a valve open position in which the first fluid flow path is open and a valve closed position in which the first fluid flow path is constricted or closed, the pipe including an openable valve uphole of the downhole tool and permitting flow of fluid from an interior of the pipe via at least one second fluid flow path interconnecting the interior of the pipe and an outside, wherein the openable valve is normally closed and the downhole tool is peripherally sealed to the interior of the pipe in a manner preventing fluid flow in the pipe via part of an exterior of the downhole tool; and causing the moveable member to constrict or close the first fluid flow path and effect an increase in a pressure of fluid in the pipe and thereby generate a signal in the pipe and cause opening of the openable valve and venting of pressurised fluid from within the pipe to the outside via the at least one second fluid flow path.

36. The method according to claim 35 wherein the downhole tool is or includes a logging tool.

37. The method according to claim 35 including a step of causing the downhole tool to move in the pipe to a position partially protruding from the pipe; and causing the moveable valve member to constrict or close the first fluid flow path and effect an increase in the pressure of fluid in the pipe.

38. The method according to claim 35 including a step of causing the downhole tool to move in the pipe to a position partially protruding from the pipe; and subsequently causing the moveable valve member to constrict or close the first fluid flow path and effect an increase in the pressure of fluid in the pipe and wherein the interior of the pipe includes one or more inwardly directed projections and the downhole tool includes one or more outwardly directed projections that are engageable with said one or more inwardly directed projections, the method including causing mutual engagement of the inwardly and outwardly directed projections that constrains the downhole tool to lie partially within the pipe with a length of the downhole tool protruding from the pipe in a downhole direction.

39. The method according to claim 35 including a step of causing the downhole tool to move in the pipe to a position partially protruding from the pipe; and subsequently causing the moveable valve member to constrict or close the first fluid flow path and effect an increase in the pressure of fluid in the pipe and wherein the interior of the pipe includes one or more inwardly directed projections and the downhole tool includes one or more outwardly directed projections that are engageable with said one or more inwardly directed projections, the method including causing mutual engagement of the inwardly and outwardly directed projections that constrains the downhole tool to lie partially within the pipe with a length of the downhole tool protruding from the pipe in a downhole direction and further including causing one or more shock absorbing elements that are retained relative to the downhole tool in a region between the one or more outwardly directed projections and the one or more inwardly directed projections to absorb impact energy on mutual engagement of the inwardly and outwardly directed projections.

40. The method according to claim 35 wherein the openable valve includes a tubular valve member that lies within the pipe and a biasing arrangement that causes the tubular valve member normally to close each of the at least one second fluid flow path; and wherein the method includes causing or permitting the biasing arrangement to bias the openable valve to a normally closed position.

41. The method according to claim 35 wherein the openable valve includes a tubular valve member that lies within the pipe and a biasing arrangement that causes the tubular valve member normally to close each of the at least one second fluid flow path; wherein the method includes causing or permitting the biasing arrangement to bias the openable valve to a normally closed position; and wherein the apparatus includes a space between the tubular valve member and the pipe, the space being bounded at either end respectively by an inwardly directed protuberance protruding towards the interior of the pipe and an outwardly directed protuberance protruding from the tubular valve member whereby to define an essentially closed chamber, the tubular valve member being perforated in a vicinity of the space and the method including causing fluid pressure acting within the tubular valve member to act on the inwardly and outwardly directed protuberances to urge them apart from one another and cause movement of the tubular valve member to open the openable valve.

42. The method according to claim 35 wherein the openable valve includes a tubular valve member that lies within the pipe and a biasing arrangement that causes the tubular valve member normally to close each of the at least one second fluid flow path; wherein the method includes causing or permitting the biasing arrangement to bias the openable valve to a normally closed position; and wherein the apparatus includes a space between the tubular valve member and the pipe, the space being bounded at either end respectively by an inwardly directed protuberance protruding towards the interior of the pipe and an outwardly directed protuberance protruding from the tubular valve member whereby to define an essentially closed chamber, the tubular valve member being perforated in a vicinity of the space and the method including causing fluid pressure acting within the tubular valve member to act on the inwardly and outwardly directed protuberances to urge them apart from one another and cause movement of the tubular valve member to open the openable valve wherein the movement of the tubular valve member opposes a biasing effect of the biasing arrangement.

43. The method according to claim 35 wherein the apparatus includes or supports one or more sensor elements and wherein the method includes operating one or more sensors that are secured relative to the downhole tool to detect the one or more sensor elements on movement of the downhole tool to a deployed location and generate one or more signals indicative of such movement of the downhole tool.

44. The method according to claim 43, wherein the one or more signals generated by the one or more sensors give rise to commands causing movement of the moveable valve member.

45. The method according to claim 35 including activating at an uphole location one or more detectors of a pressure pulse that arises at a time of venting of pressurised fluid from within the pipe to the outside via each of the at least one second fluid flow path, and causing the one or more detectors to generate one or more signals indicative of such a pressure pulse.

46. The method according to claim 35 including activating at an uphole location one or more detectors of a pressure pulse that arises at a time of venting of pressurised fluid from within the pipe to the outside via each of the at least one second fluid flow path, and causing the one or more detectors to generate one or more signals indicative of such a pressure pulse; wherein the uphole location is a surface location.

47. The method according to claim 35 including operating one or more processors for processing one or more signals generated by one or more sensors and generating one or more control commands based on the one or more signals.

48. The method according to claim 35 including operating one or more processors for processing one or more signals generated by one or more sensors and generating one or more control commands based on the one or more signals, the method further including causing the downhole tool to respond to the one or more control commands by one or more of initiating an action, continuing the action, ceasing the action and/or modifying the action.

49. The method according to claim 35 including operating one or more processors for processing one or more signals generated by one or more sensors and generating one or more control commands based on the one or more signals, the method further including causing the downhole tool to respond to the one or more control commands by one or more of initiating an action, continuing the action, ceasing the action and/or modifying the action and wherein the action is selected from a list including deploying one or more deployable components; commencing logging activity; terminating logging activity; adjusting a parameter of logging activity; processing one or more signals resulting from logging activity; requesting diagnostic information and/or responding to one or more requests for diagnostic information.

50. The method according to claim 35 including activating at an uphole location one or more detectors of a pressure pulse that arises at a time of venting of pressurised fluid from within the pipe to the outside via each of the at least one second fluid flow path, and causing the one or more detectors to generate one or more signals indicative of such a pressure pulse, the method including causing one or more processors to process the one or more signals generated by the one or more detectors and generate one or more indications based on the one or more signals.

51. The method according to claim 35 including activating at an uphole location one or more detectors of a pressure pulse that arises at a time of venting of pressurised fluid from within the pipe to the outside via each of the at least one second fluid flow path, and causing the one or more detectors to generate one or more signals indicative of such a pressure pulse, the method including causing one or more processors to process the one or more signals generated by the one or more detectors and generate one or more indications based on the one or more signals and wherein the one or more indications include one or more selected from a list including an indication of deployment of the downhole tool; an indication of failure of the downhole tool to deploy; and/or diagnostic information received from the downhole tool.

52. The method according to claim 35 including activating at an uphole location one or more detectors of a pressure pulse that arises at a time of venting of pressurised fluid from within the pipe to the outside via each of the at least one second fluid flow path, and causing the one or more detectors to generate one or more signals indicative of such a pressure pulse, the method including causing one or more processors to process the one or more signals generated by the one or more detectors and generate one or more indications based on the one or more signals, wherein the one or more indications include one or more selected from a list including an indication of deployment of the downhole tool; an indication of failure of the downhole tool to deploy; and/or diagnostic information received from the downhole tool; and the method additionally includes one or more of (a) causing one or more display devices to display the one or more indications; (b) causing one or more printing devices to print indicia representing the one or more indications; (c) causing one or more memory devices to record data characteristic of the one or more indications; or (d) generating one or more visible or audible alerts.

* * * * *